US006835143B2

(12) United States Patent
Shiraishi

(10) Patent No.: US 6,835,143 B2
(45) Date of Patent: Dec. 28, 2004

(54) METHOD OF EVALUATING GOLF CLUB, GOLF CLUB, AND GOLF CLUB SET

(75) Inventor: Takayuki Shiraishi, Kanagawa (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 10/134,462

(22) Filed: Apr. 30, 2002

(65) Prior Publication Data

US 2003/0073507 A1 Apr. 17, 2003

Related U.S. Application Data

(62) Division of application No. 09/799,728, filed on Mar. 7, 2001, now Pat. No. 6,602,147.

(30) Foreign Application Priority Data

Mar. 7, 2000 (JP) ..... 2000-62132
Oct. 12, 2000 (JP) ..... 2000-311837

(51) Int. Cl.[7] ..... A63B 53/04
(52) U.S. Cl. ..... 473/291; 473/349
(58) Field of Search ..... 473/290, 291, 473/345, 349

(56) References Cited

U.S. PATENT DOCUMENTS 4,687,205 A * 8/1987 Tominaga et al. ..... 473/348
4,840,380 A * 6/1989 Kajita et al. ..... 473/291
4,858,929 A * 8/1989 Long ..... 473/290
5,351,953 A * 10/1994 Mase ..... 473/289
5,413,336 A * 5/1995 Iwanaga ..... 473/291

FOREIGN PATENT DOCUMENTS

| | | |
|---|---|---|
| JP | 08-126723 | 5/1996 |
| JP | 11-276642 | * 10/1999 |
| JP | 11-319156 | * 11/1999 |

* cited by examiner

*Primary Examiner*—Stephen Blau
(74) *Attorney, Agent, or Firm*—Finnegan and Henderson, Farabow, Garrett & Dunner, L.L.P.

(57) ABSTRACT

A golf club is evaluated by measuring a moment of inertia about an axis perpendicular to a face plane of the golf club head through a center of a mass of the golf club head. The golf club has the evaluation imparted by a moment of inertia information relating to a value of the moment of inertia or a value obtained by dividing the moment of inertia by a mass value of the golf club head. A golf club set is composed of at least three golf clubs having different loft angles and each of the golf clubs has the size of the moment of inertia adjusted corresponding to an order of golf club number or an order of a value of the loft angle. The moment of inertia changes linearly corresponding to the order of the golf club number or the loft angle.

10 Claims, 18 Drawing Sheets

FIG. 14A

2500g·cm²
NUMERICAL VALUE OF THE MOMENT OF INERTIA ABOUT A LINE NORMAL TO THE FACE PLANE
THE LARGER THE NUMERICAL VALUES, THE LARGER THE SWEET AREA
2500 HAS A SHARP FEELING

FIG. 14B

3000g·cm²
NUMERICAL VALUE OF THE MOMENT OF INERTIA ABOUT A LINE NORMAL TO THE FACE PLANE
THE LARGER THE NUMERICAL VALUES, THE LARGER THE SWEET AREA
3000 HAS A STANDARD FEELING

FIG. 14C

3500g·cm²
NUMERICAL VALUE OF THE MOMENT OF INERTIA ABOUT A LINE NORMAL TO THE FACE PLANE
THE LARGER THE NUMERICAL VALUES, THE LARGER THE SWEET AREA
3500 HAS AN EASY FEELING

| | | | |
|---|---|---|---|
| ★2400~2600 | 1 | SHARP | DISPLAYED BY MOMENT OF INERTIA (g·cm²) IN FACE PLANE DIRECTION |
| 2600~2800 | 2 | SOMEWHAT SHARP | |
| 2800~3000 | 3 | MODERATE | |
| 3000~3200 | 4 | SOMEWHAT EASY | |
| 3200~3400 | 5 | EASY | |

| DISPLAYED | M. O. I (g·cm²) | LEVEL | SWEET SPOT |
|---|---|---|---|
| 1 | 2200~2500 | 1 | EXTREMELY NARROW |
| | 2500~2800 | 2 | NARROW |
| | 2800~3100 | 3 | AVERAGE |
| | 3100~3400 | 4 | WIDE |
| | 3400~3700 | 5 | EXTREMELY WIDE |

FIG.17A

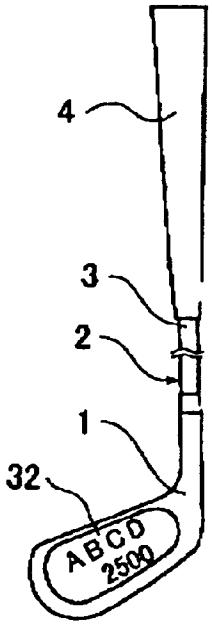

FIG.17B

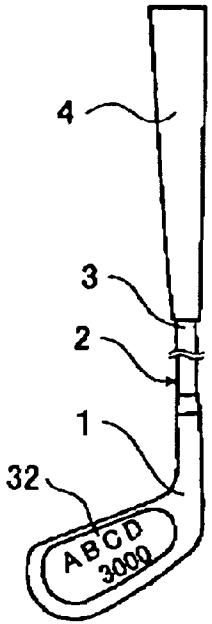

FIG.17C

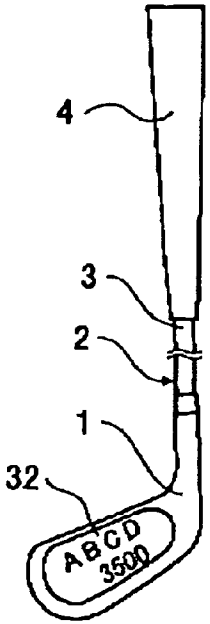

FIG.17D

M

ABCD SERIES

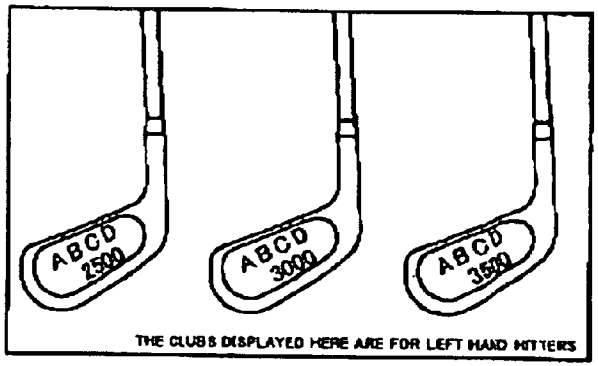

THE ABCD SERIES ACCURATELY SHOWS THE SIZE OF THE SWEET AREA BY THE SWEET AREA DISPLAY SYSTEM

| TYPE | SWEET AREA | SUITABLE GOLFER FOR THIS TYPE |
|---|---|---|
| 2500 | NARROW | ADVANCED |
| 3000 | AVERAGE | INTERMEDIATE,ADVANCED |
| 3500 | LARGE | BEGINNER |

※SWEET AREA DISPLAY SYSTEM
THE SIZE OF THE SWEET AREA IS DISPLAYED BY THE NUMERICAL VALUE OF THE MOMENT OF INERTIA ABOUT A ROTATION AXIS NORMAL TO THE FACE PLANE AND THROUGH THE CENTER OF MASS OF THE CLUB HEAD.
THE 2500, 3000, AND 3500 OF THE ABCD SERIES ARE NUMERICAL VALUES OF THE MOMENT OF INERTIA($g \cdot cm^2$). IT BECOMES POSSIBLE TO DISPLAY THE SIZE OF THE SWEET AREA MORE ACCURATELY COMPARED TO CONVENTIONAL INDICATING METHODS.
THE HIGHER THE VALUE, THE LARGER THE SIZE OF THE SWEET AREA.

| MODEL | MOI(g·cm²) |
|---|---|
| M443 | 2000 |
| M433 | 2500 |
| M423 | 3000 |
| M413 | 3500 |

METHOD OF EVALUATING GOLF CLUB, GOLF CLUB, AND GOLF CLUB SET

This is a division of application Ser. No. 09/799,728, filed Mar. 7, 2001, now U.S. Pat. No. 6,602,147, which is incorporated herein by reference.

BACKGROUND OF THE INVENTION

1. Field of the Invention

The present invention relates to a method of evaluating a golf club, and to a golf club which has been evaluated in accordance with the method of evaluating a golf club. In particular, the present invention relates to a method of evaluating a golf club, and a golf club, in which the size of a sweet area of the golf club is able to be accurately indicated, and to a golf club set having a plurality of such golf clubs in which the golf clubs differ in loft angle and in club length.

2. Description of the Related Art

Golfers often rely upon the golf clubs in order to obtain a good score, in addition to improving their skill in order to achieve good golf play. A good performance of the golf clubs is therefore always desired by many golfers. The good performance, for example, has a meaning of long distance of a golf ball flight and ease of hitting a golf ball. In particular, the ease of hitting is evaluated from a subjective standpoint along with an objective standpoint in which the variation of the golf ball flight becomes small between cases of hitting a golf ball at the center of the golf club face and cases of hitting a golf ball off the center. This is generally discussed by the size of the sweet area. Namely, golf clubs are evaluated such that the larger the sweet area of the golf club, the smaller the variation (drop in flight distance, and lateral shift of a golf ball flight) becomes between cases of hitting at the center and cases of hitting off the center.

The size of the sweet area of the golf club depends upon the golf club head, and as stated later, is mainly evaluated in accordance with the numerical value of a moment of inertia about a specific axis of the golf club head itself. In other words, from the numerical value of the moment of inertia, the degree of a steady performance of the golf club head when the golf club head hits a golf ball off a sweet spot can be obtained, and the larger the numerical value of the moment of inertia, the less unsteady performance the golf club head has in hitting off the center, and the more similar the golf ball flight of hitting off the center comes to a golf ball flight of hitting at a sweet area. Namely, when the difference between cases of hits at the center of the golf club and cases of hits off the center becomes small, it can be evaluated that the golf club has a large sweet area.

In Japanese Patent No. 2851542, a technique is disclosed for increasing the moment of inertia with respect to a golf club head, in a state in which its sole is placed in a horizontal plane, about a horizontal axis parallel to the plane of the club face through the center of mass (moment of inertia about an X axis in the above patent), and the moment of inertia about a vertical axis through the center of mass (moment of inertia about a Y axis in the above patent) , thereby enlarging the sweet area, by setting the thickness and the volume of the golf club head.

In particular, the most generally used value of the moment of inertia by those skilled in the art is a value of the moment of inertia about the vertical axis parallel to the vertical direction through the center of mass of the golf club head, also shown in the above Japanese Patent No. 2851542. The value of the moment of inertia measured around this axis is generally used for evaluating the size of the sweet area.

The above axes about which the moments are measured are selected on the assumption that the golf club head rotates in directions when the sweet area of the golf club head is missed. For example, the axis parallel to the plane of the hitting surface of the golf club head, through the center of mass, and in a horizontal direction shown in Japanese Patent No. 2851542 (the X axis shown in FIG. 1 of the above patent) is an axis of rotation of the golf club head when a golf ball is hit while missing the sweet area up and down in a vertical direction. The axis in a vertical direction through the center of mass of the golf club head (the Y axis shown in FIG. 1 of the above patent) is an axis of rotation of the golf club head when a golf ball is hit while missing the sweet area of a golf club head in a toe and heel (lateral) direction.

When an ordinary golfer misses the sweet area while hitting there is no certain tendency of the miss, in the toe and heal direction or in the vertical direction, and generally hitting points on the golf club surface are variously varied around the sweet area.

However, the moment of inertia about the axis parallel to the plane of the hitting surface of the golf club head, through the center of mass, and in a horizontal direction, such as that of the above Japanese Patent No. 2851542, can only indicate the steady performance of the golf club head when hitting while missing the sweet area in a vertical direction, namely the size of the sweet area in the vertical direction. Further, the moment of inertia around the axis in a vertical direction through the center of mass can only indicate the steady performance of the golf club head when hitting while missing the sweet area in a toe and heel direction, namely the size of the sweet area in the toe and heel direction.

The two moments of inertia of the above Japanese Patent No. 2851542 therefore cannot be used as indicators for unambiguously and accurately evaluating the size of the sweet area based upon a golfer's tendency that the hitting points are variously varied around the sweet area.

In other words, although the golf club head can be made to have relatively steady performance even in cases in which an ordinary golfer hits while missing the sweet area, and a golf ball flight relatively similar to a golf ball flight that occurs when hitting the ball at the sweet area can be stably realized, by evenly increasing the moment of inertia about the axis around the toe and heel direction, and the moment of inertia about the axis of the up and down direction, it is difficult to accurately increase the size of the sweet area quantitatively by increasing these moments of inertia, and it is difficult to accurately indicate the size of the sweet area by these moments of inertia.

Additionally, golfers have different skill levels such as those of beginners, intermediate golfers, and further advanced golfers. For example, beginners who often hit a golf ball while missing the sweet area, wants to select a golf club which will make almost the same golf ball flight as that of hitting at the sweet area, even when the sweet area is missed, and which impresses beginners a good sense of stability. On the other hand, there are many times when an advanced golfer will intentionally hit the golf ball off the sweet area in order to control the flight of the golf ball by subtly changing the striking direction of the ball and imparting spin to the ball. Advanced golfers desire to select a golf club with good controllability in which the ball flight can be controlled by the extent that a golf ball is hitted off the sweet area intentionally.

Although there are golf clubs classified toward advanced golfers, intermediate golfers, and beginning golfers in accordance with their level of skill, the golfer must evaluate a golf club subjectively by hitting it numerous times in order to select a golf club having a suitable size of the sweet area for that golfer. However, the evaluation cannot be obtained only from the size of the golf club sweet area, but from factors such as the moment of inertia around the axis of the golf club shaft, and the set value of the lie angle of the golf club head and the like, as the overall performance.

Therefore, whether a golf club is one impressing golfers sense of stability and producing results almost the same as those of hitting at the sweet area even when the sweet area is missed, whether it is one impressing golfers good controllability in which the ball flight can be controlled by the extent at which the sweet area is missed, or whether the golf club is one located between these characteristics, discerning the stability and controllability of golf clubs and selecting a golf club which is suitable for golfers is difficult for golfers.

On the other hand, golfers play golf using a plurality of such golf clubs, at most fourteen golf clubs having differing club lengths and differing loft angles.

For example, wood type golf clubs such as a number 1, number 3, and number 5 wood, numbers 3 through 9 irons, a pitching wedge and a sand wedge are arranged, and the golf clubs are suitably selected and hit a golf ball based upon the distance to the pin.

In particular, in order to make accurate shots of the golf ball to the pin, it is preferable to control the flight distance accurately in accordance with iron club number.

However, the ball flight distance changes as stated above for cases in which the club head is hit at the center and for cases in which the club head is not hit at the center, and therefore variation in the ball flight distance appears. Many types of golf clubs having a wide sweet spot and impressing a sense of stability, and with which the shot results are almost similar to those of a sweet area hit are obtained even when the center is missed, have therefore been proposed.

However, there are many golfers who, from a strategy for playing a golf in a golf course, prefer to utilize the lateral shift of a ball flight when they strike the golf club for small loft angles of golf clubs, thereby controlling the ball flight, while relatively suppressing the variation in ball flight distance and variation in the lateral shift of the struck ball when the golf club is hit off the center, and at the same time prefer to suppress the lateral shift of a ball struck by a golf club having a large loft angle. Further, there is also a lot of demand even among such as beginner golfers, who easily hit off the center, for golf clubs with which more accurate shot can be made toward the pin as the golf club number increase. However, at present it is not well understood how to adjust the sweet areas of a plurality of golf clubs, such as irons in accordance with the club number, with respect to the demands of those types of golfers.

Further, when a beginner golfer hits who easily misses the center, or an intermediate to advanced golfer hits who may miss the center, using a golf club set in which the sweet area of a 6 iron, for example, has a sweet area which is large compared to a 5 iron, a result tends to occur that the 6 iron performs a relatively long flight distance in comparison to a flight distance which is set in a manner that the flight distance with respect to golf club number changes by approximately 10 yards for every change by the club number. In addition, the difference in ball flight distance between the 6 iron and a 7 iron becomes greater. There are therefore many cases in which it is extremely difficult to control the flight distance based upon the number of the golf club. In addition, although in general the demand for an accurate shot directed toward the pin increases with increasing the golf club number, a problem develops in that, compared to the number 6 iron, an accurate shot cannot be make with the number 7 iron. This type of golf club set, and these types of golf clubs, therefore have incompatibilities in that they do not sufficiently perform desirable function corresponding to their club number, and in addition impart distrust to the golfer.

SUMMARY OF THE INVENTION

An object of the present invention is therefore to provide a method of evaluating a golf club in which it is possible to accurately indicate the size of a sweet area of the golf club, which influences the golfer's impression of stability and controllability of the golf club, and a golf club given an evaluation in accordance with the method of evaluation. In addition, an object of the present invention is to provide a golf club set composed of a plurality of golf clubs having differing loft angles, in which variation in ball flight distance is regulated with respect to the number of the golf club based upon an index accurately indicating the size of a sweet area.

To solve the problems, the present invention provides a method of evaluating a golf club having a golf club head, comprising a step of measuring a moment of inertia about an axis perpendicular to a face plane of the golf club head through a center of gravity of the golf club head and a step of evaluating the golf club by the measured moment of inertia.

In the invention, the golf club may be evaluated by dividing the measured moment of inertia by a mass value of the golf club head.

The present invention also provides a golf club comprising a golf club shaft having a golf club head at one end and a grip or a grip portion at an opposite end to the end of the golf club head, wherein the golf club has an evaluation imparted based upon a moment of inertia about an axis perpendicular to a face plane of the golf club head through a center of gravity of the golf club head.

It is preferable that moment of inertia information relating to a value of the moment of inertia; or moment of inertia information relating to a value which is obtained by dividing the value of the moment of inertia by a mass value of the golf club head is indicated on a portion of the golf club.

In the invention, the moment of inertia information is used in order to obtain a golf club evaluation information by referring to a reference information in which the moment of inertia information and the golf club evaluation information correspond to each other.

Preferably, the reference information for obtaining the golf club evaluation information, based upon the moment of inertia information, is displayed on a portion of the golf club along with the moment of inertia information.

The golf club may be classified into a type based upon a value of the moment of inertia, or upon a value obtained by dividing the value of the moment of inertia by a mass value of the golf club head.

Further, the invention provides a golf club set comprising at least three golf clubs having different loft angles, wherein each of the golf clubs has the size of the moment of inertia about an axis perpendicular to a face plane of a golf club head through a center of gravity of the golf club head adjusted corresponding to an order of golf club number, or corresponding to an order of value of loft angle.

It is preferable that the moment of inertia changes almost linearly in correspondence with the order of the golf club number.

It is also preferable that the golf club set has a group of at least three golf clubs having loft angles in a range greater than or equal to 16° and less than or equal to 41°, and when each of the golf clubs of the group is expressed as continuous natural number X, beginning with a smallest golf club number which is taken as X=1, and when the moment of inertia is taken as Y ($g \cdot cm^2$), then the moment of inertia Y of each of the golf clubs of the group is adjusted within a range defined by equation (1) below, with respect to the natural number X:

$$a \cdot X+b \leqq Y \leqq a \cdot X+b+50 \quad (1)$$

where coefficients a and b are constants.

Then, the coefficient a of the equation (1) may be equal to or less than 60, for a golf club set suitable to some golfers.

Alternatively, the coefficient a of equation (1) maybe greater than 60, for a golf club suitable to other golfers.

It is preferable that the golf club set has a group of at least three golf clubs having loft angles in a range greater than or equal to 16° and less than or equal to 41°, and when each of the golf clubs of the group is expressed as continuous natural numbers X, beginning with a smallest golf club number which is taken as X=1, and when a distribution of the moments of inertias of all of the golf clubs of the group with respect to the natural number X is regressed by a regression line, the sizes of the moments of inertia of all of the golf clubs of the group are adjusted such that all of estimated errors in the regression line of the moments of inertias of all of the golf clubs of the group are equal to or less than 30 ($g \cdot cm^2$).

It is preferable that the moment of inertia changes almost linearly in correspondence with the size of the loft angle of each of the golf clubs.

It is also preferable that the golf club set has a group of at least three golf clubs having loft angles in a range greater than or equal to 16° and less than or equal to 41°, and when the loft angle of each of the golf clubs of the group is taken as θ°, and the moment of inertia is taken as Y ($g \cdot cm^2$) , then the moment of inertia Y of each of the golf clubs of the group is adjusted within a range defined by equation (2) below, with respect to the loft angle θ:

$$c \cdot \theta+d \leqq Y \leqq c \cdot \theta+d+50, \quad (2)$$

where coefficients c and d are constants.

Then, the coefficient c of the equation (2) may be equal to or less than 15 for a golf club set suitable to some golfers.

Alternatively, the coefficient c of the equation (2) may be greater than 15 for a golf club set suitable to some golfers.

It is preferable that the golf club set has a group of at least three golf clubs having loft angles in a range greater than or equal to 16° and less than or equal to 41°, and when a distribution of the moments of inertias of all of the golf clubs of the group with respect to the loft angles is regressed by a regression line, the sizes of the moments of inertias of all of the golf clubs of the group are adjusted such that all of estimated errors in the regression line of the moments of inertias of all of the golf clubs of the group are equal to or less than 30 ($g \cdot cm^2$).

BRIEF DESCRIPTION OF THE DRAWINGS

In the accompanying drawings:

FIGS. 14A to 14C are enlarged planar view diagrams of portions showing an embodiment for displaying information in a portion of a golf club of the present invention;

FIGS. 17A to 17C are enlarged planar view diagrams of portion showing another embodiment of a golf club of the present invention, and FIG. 17D is a diagram showing an example of the display contents of an external display medium for recognizing the characteristics of a golf club of the present invention;

DETAILED DESCRIPTION OF THE PREFERRED EMBODIMENTS

A method of evaluating a golf club of the present invention is an evaluation method for a golf club in accordance with measuring a moment of inertia about an axis perpendicular to a face plane of a golf club head, through the center of mass of the golf club head. The method of evaluating a golf club of the present invention is explained based upon a moment of inertia measurement apparatus 11 shown in FIG. 1 for measuring the moment of inertia of the golf club.

Figure 1:
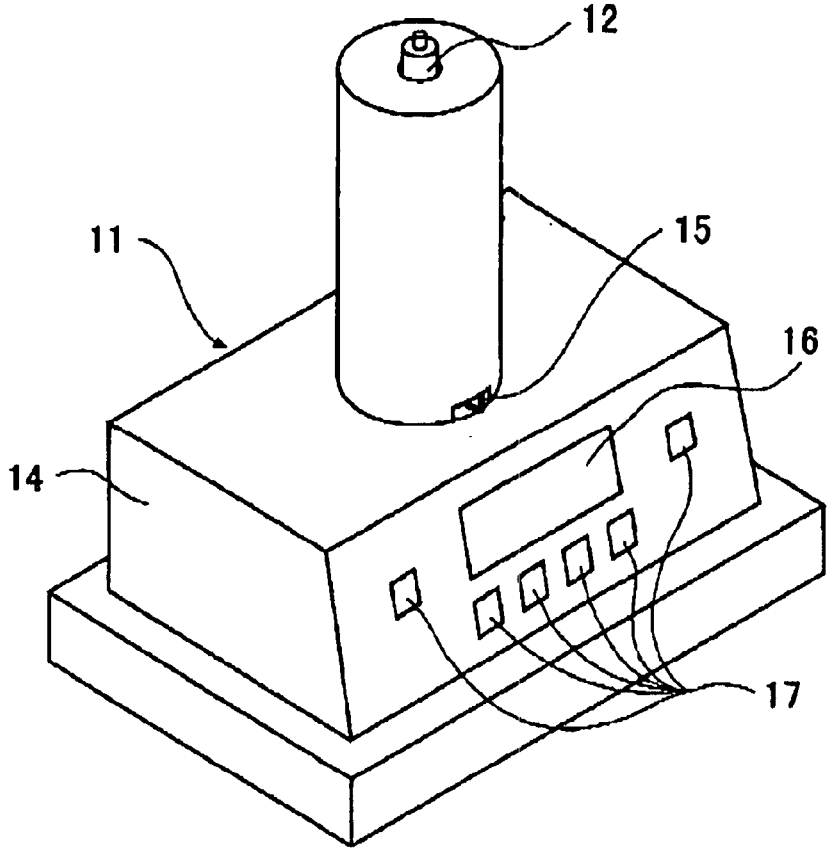
FIG. 1 is a schematic perspective diagram showing an example of a moment of inertia measurement apparatus when measuring a moment of inertia by a golf club evaluation method of the present invention.

FIG. 1 is a perspective diagram of the moment of inertia measurement apparatus 11.

The moment of inertia measurement apparatus 11 has a measuring portion 12, a calculation portion 14, a start lever 15, a display portion 16, and operation buttons 17. An object for moment of inertia measurement is mounted on the measuring portion 12, and after the start lever 15 is displaced by being plucked by hand, the hand is removed and the measuring portion 12 rotates and vibrates torsionally. The moment of inertia is measured through the calculation portion 14 by measuring the period of the torsional vibrations at this point, and a numerical value of the moment of inertia is displayed in the display portion 16.

Note that an Inertia Dynamics Corporation moment of inertia measurement apparatus Model Moment of Inertia-005-014 is shown as an example of the moment of inertia measurement apparatus 11. There is no particular limitation on this type of moment of inertia measurement apparatus with the present invention, provided that it is a known moment of inertia measurement apparatus.

A method of evaluating a golf club of the present invention is explained.

Figure 2A:
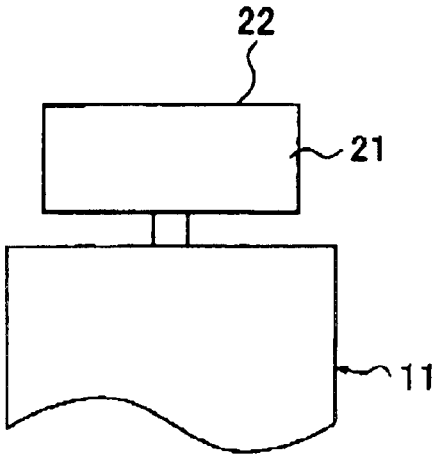
FIGS. 2A and 2B are front view diagrams showing a jig for the moment of inertia measurement apparatus shown in FIG. 1, and a state in which the jig and a golf club head are fixed, respectively.
Figure 2B:
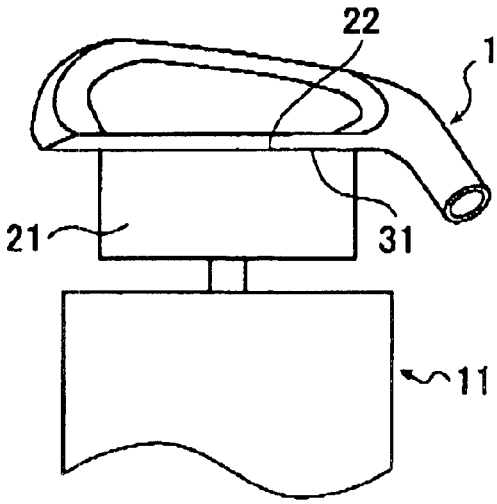

If the method of measuring the moment of inertia in the method of evaluating a golf club of the present invention is explained using an example of a case in which the golf club is an iron, then a jig 21 is fixed to the moment of inertia measurement apparatus 11 and a moment of inertia Ia is measured, as shown in FIG. 2A. A face plane 31 of a golf club head 1 of the iron is then fixed to a top surface portion 22 of the jig 21, as shown in FIG. 2B, and a moment of inertia Ib is measured. The moment of inertia of the golf club head is obtained from (Ib−Ia). With a normal moment of inertia measurement apparatus, the numerical value of Ia is automatically removed by a procedure using the operation switches 17, and the numerical value of (Ib−Ia) is displayed.

Figure 3A:
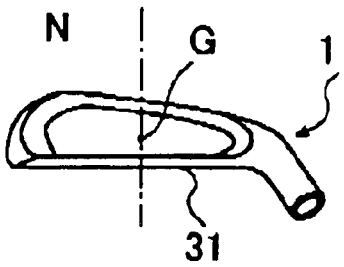
FIGS. 3A to 3C are explanation diagrams for explaining fixing positions of the golf club head shown in FIG. 2B.
Figure 3B:
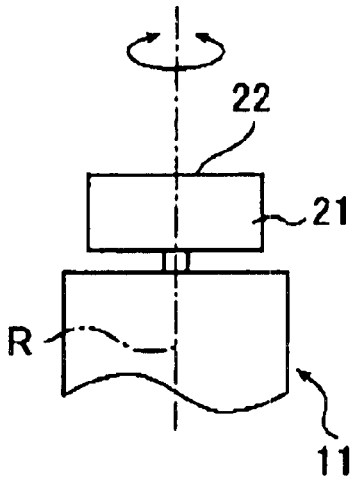
Figure 3C:
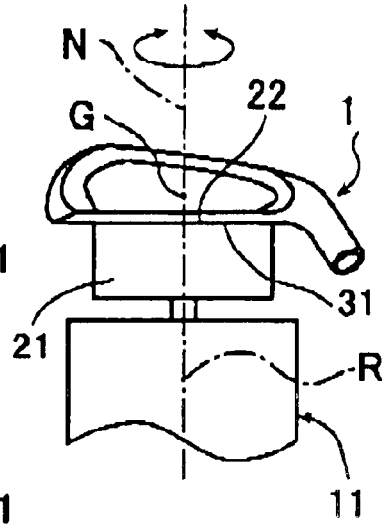
Figure 4:
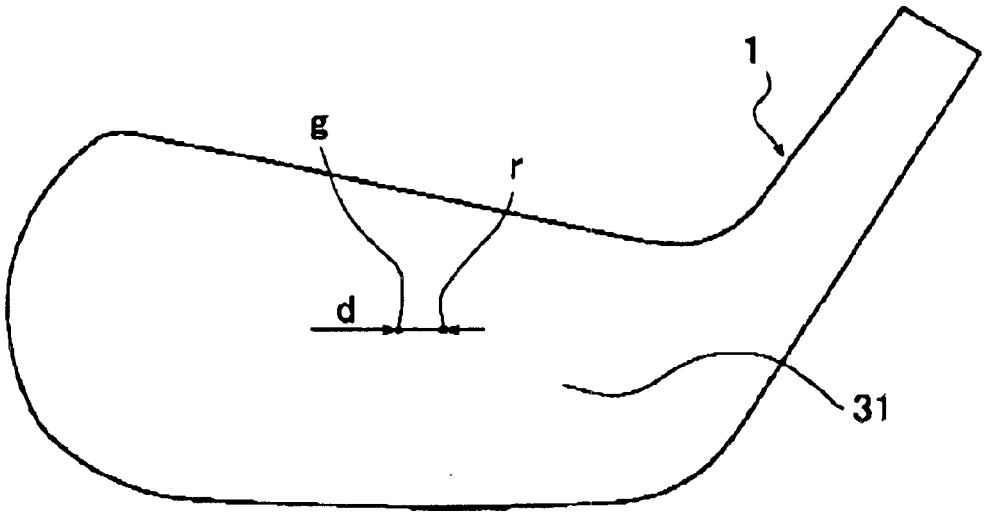
FIG. 4 is an explanation diagram for explaining the golf club head fixing position shown in FIG. 2B on a face plane.

It is preferable to fix the golf club head 1 to the moment of inertia measurement apparatus 11 so that a line N normal to the face plane 31 through a center of mass G of the golf club head 1 shown in FIG. 3A, and an axis of rotation R for torsional vibration of the moment of inertia measurement apparatus 11 shown in FIG. 3B coincide, or nearly coincide as shown in FIG. 3C. The term nearly coincide denotes that, as shown in FIG. 4, by taking the point at which the normal line N passes through the face plane 31 as point g, and taking the point on the face place 31 at which the axis of rotation R passes through as point r, then a distance d between the point g and the point r is equal to or less than 3 mm, preferably equal to or less than 2 mm, and more preferably equal to or less than 1 mm. It becomes possible to very accurately measure the moment of inertia of the present invention by fixing the face plane 31 of the golf club head within this range. The face place 31 of the golf club head 1 of the iron is a level surface, and contacts neatly with the top surface portion 22 of the jig 21, and therefore the moment of inertia in a direction perpendicular to the face plane 31 and through the center of mass G of the golf club head can be obtained by making the point g and the point r coincide or nearly coincide.

Further, it is not always necessary that the distance d between the point g and the point r falls within the above range, and correction can be performed by knowing the distance d between the point g and the point r, and subtracting the product of the mass of the golf club head 1 by the distance d squared from the numerical value of (Ib−Ia) obtained after automatic subtraction. The moment of inertia of the direction perpendicular to the face plane 31 through the center of mass G of the golf club head may also be obtained in accordance with this method of correction. There are thus no particular limitations regarding the method of measuring the moment of inertia in the direction perpendicular to the face plane 31 through the center of mass G of the golf club head.

Figure 5:
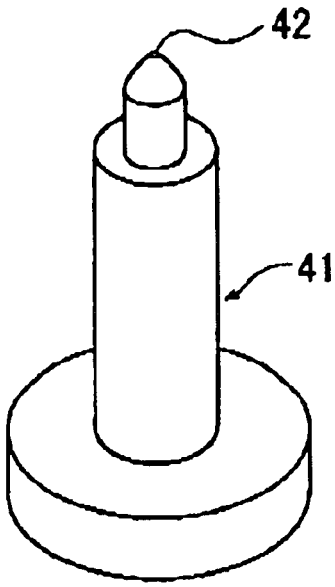
FIG. 5 is a perspective view diagram showing a center of mass detecting apparatus using a golf club evaluation method relating to the present invention.
Figure 6:
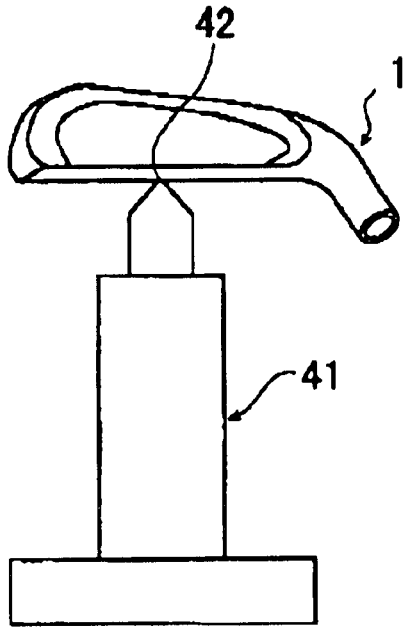
FIG. 6 is a front view diagram showing a state in which a golf club head is riding on the center of mass detecting apparatus shown in FIG. 5.
Figure 7A:
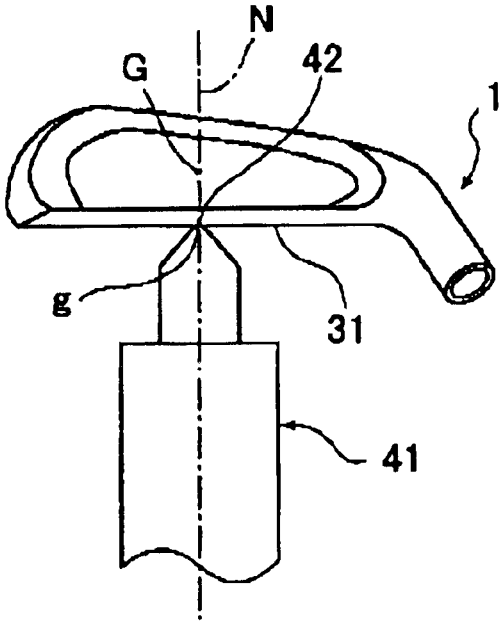
FIGS. 7A and 7B are explanation diagrams for explaining the golf club head riding position shown in FIG. 6.
Figure 7B:
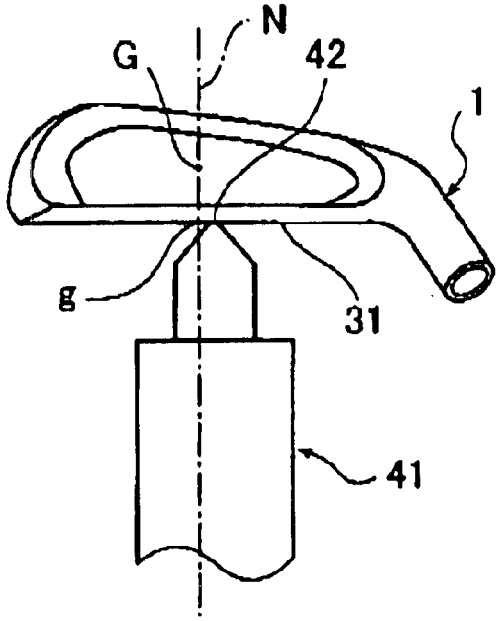

The point g on the face plane 31 of the golf club 1 is found in accordance with a center of mass detecting apparatus 41 shown in FIG. 5. The center of mass detecting apparatus 41 has a support portion 42 in an upper portion for supporting an object for center of mass detection, and the position of the object supported in equilibrium by the support portion 42 may be known. Namely, the method of detecting the center of mass is such that the golf club head 1 is set upon the support portion 42, and an equilibrium position at which it does not fall down when an operator's hand is removed is sought, as shown in FIG. 6. In other words, provided that the point g is contained within a contacting portion between the face plane 31 and the support portion 42, the golf club head 1 does not fall after being placed on the support portion 42 after operator's hand is removed, as shown in FIG. 7A, but if the point g is not contained within the contacting portion between the face plane 31 and the support portion 42, as shown in FIG. 7B, the golf club head 1 still falls after being placed on the support portion 42 and operator's hand is removed. The point g is found by utilizing this.

It is preferable that the support portion 42 have a form in which it is supported in a plane, or by at least three points. Further, it is preferable that the surface area of the support portion 42 be equal to or less than 15 $mm^2$. Furthermore, there is no minimum amount for the surface area, provided that the golf club head can be supported. The surface area of the support portion 42 denotes the surface area of a planer portion provided that the support portion 42 is planer, and denotes the surface area of a figure in which each point is connected for a case of having support at three or more points. The point g can be very accurately found by setting the surface area of the support portion 42 within the above range.

Figure 8:
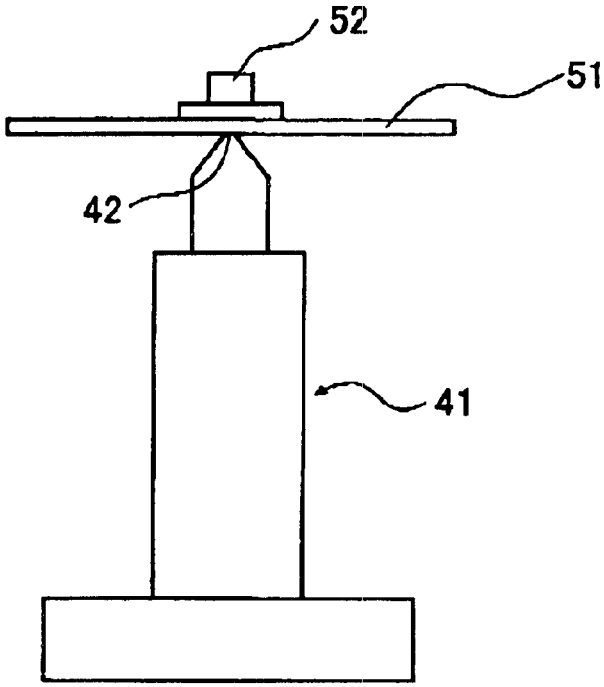
FIG. 8 is an explanation diagram for explaining a preferable disposition of the center of mass detecting apparatus shown in FIG. 5.

It is preferable that the plane supported by the support portion 42 be horizontal or nearly horizontal. The term nearly horizontal indicates a slope equal to or less than 2°, preferably equal to or less than 1°, with respect to a horizontal plane. Whether or not the plane is horizontal or nearly horizontal can be investigated and adjusted by, for example, placing a planar plate 51 on the support portion 42 and supporting the plate, and then placing a sprit level apparatus 52 on the planer plate 51, as shown in FIG. 8. It becomes possible to find the point g with very good accuracy by setting the angle within the above range.

The axis of rotation R of the moment of inertia measurement apparatus 11 and the point r are determined in accordance with the moment of inertia measurement apparatus 11. It is preferable that the axis of rotation R be vertical or nearly vertical. The term nearly vertical indicates a slope equal to or less than 2°, preferably equal to or less than 1°, with respect to a vertical plane. In order to set the axis of rotation R to be vertical or nearly vertical, a means such as level adjustment of the measurement apparatus performed by using the spirit level apparatus provided on the moment of inertia measurement apparatus 11, or disposing the measurement apparatus on the planar plate which has been adjusted to be horizontal, ran be considered. The moment of inertia about an axis perpendicular to the face plane 31 and through the center of mass G of the golf club head 1 can be very accurately measured by setting the axis of rotation R to be within the above range.

It is preferable that the plane supported by the top surface portion 22 of the jig 21 be horizontal or nearly horizontal. The term nearly horizontal indicates a slope equal to or less than 2°, preferably equal to or less than 1°, with respect to a horizontal plane. Whether or not the plane is horizontal or nearly horizontal can be found and adjusted by using a method similar to that used for the example of the support portion 42 shown in FIG. 8 above. The moment of inertia about an axis perpendicular to the face plane 31 and through the center of mass G of the golf club head 1 can be very accurately measured by setting the plane supported by the top surface portion 22 to be within the above range.

Figure 9:
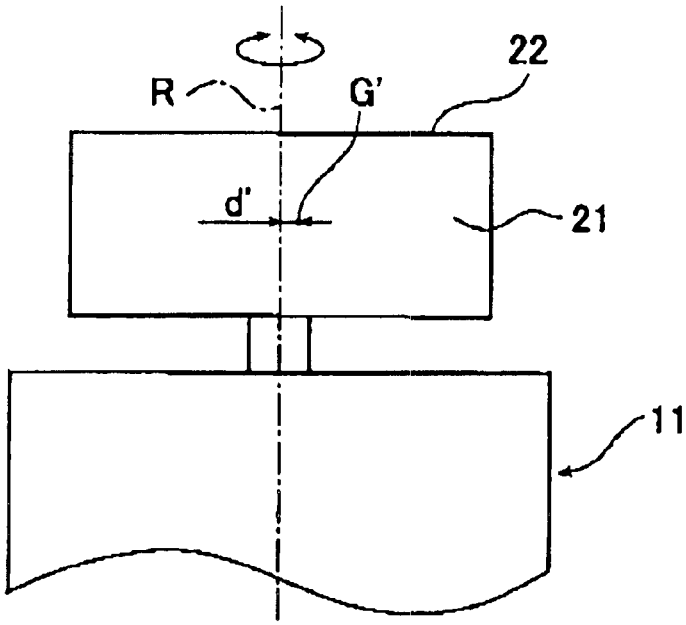
FIG. 9 is an explanation diagram for explaining an example of state of a jig used in the present invention.

Further, it is preferable that the jig 21 be mounted to the moment of inertia measurement apparatus 11 such that the position of the center of mass of the jig itself coincides with, or nearly coincides with, the axis of rotation R. The term nearly coincides with indicates that, taking the position of the center of mass of the jig 21 as G' as shown in FIG. 9, a distance d' formed between the center of mass position G' and the axis of rotation R is equal to or less than 2 mm, preferably equal to or less than 1 mm. The moment of inertia about an axis perpendicular to the face plane 31 and through the center of mass G of the golf club head 1 can be very accurately measured by setting the position G' of the center of mass of the jig 21 to be within the above range.

Figure 10:
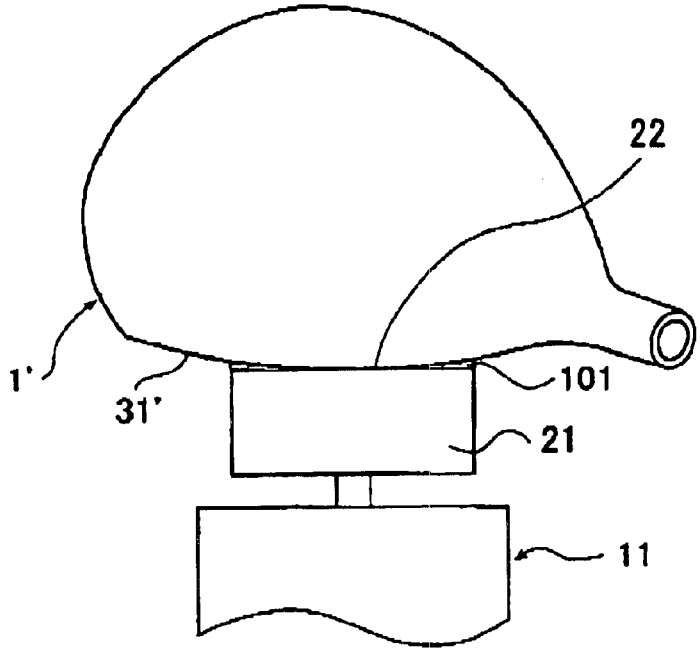
FIG. 10 is an explanation diagram for explaining a method of fixing a golf club head having a round face to a jig on the moment of inertia measuring apparatus.

In order to fix the golf club head 1 and the jig 21, a means such as: fixing in accordance with an adhesive body such as double sided tape or clay; fixing by use of an adhesive glue; and fixing by use of magnetic force can be considered. The face plane 31 of the golf club head 1 is fixed to the top surface portion 22 of the jig 21, and if the face plane 31 is planar, then it is preferable that the top surface portion 22 be planar. For example, if the face plane has a convex curved surface such as that of a wood golf club, then it is preferable that the top surface portion 22 have a concave curved surface such that both surfaces coincide. Further, for a case in which a convex curved surface of a face plane 31', for example, is fixed to the top surface portion 22 which is planar and both surfaces do not sufficiently coincide, a means can be considered in which an adhesive body 101 is formed such that the face plane 31' and the top surface portion 22 will coincide, as shown in FIG. 10. When using a means of fixing such as an adhesive glue like the adhesive body 101, since the glue itself has mass, of course, the mass is included as a portion of the jig. The mass is therefore subtracted in a fashion similar to the mass of the jig.

How much mass is distributed in the periphery of the center of mass of the golf club head can thus be understood by measuring the moment of inertia about an axis perpendicular to the face plane 31 or the face plane 31', and through the center of mass G, of the golf club head 1. The size of the sweet area of the golf club head is thus understood.

With conventional moment of inertia measurement, a direction in which the golf club head moves when hitting while missing the sweet area, i.e. the direction of rotation of the golf club head, is assumed, and the moment of inertia around the axis of this rotation direction is measured and then the result is utilized in evaluating the size of the sweet area. However, evaluation of the size of the sweet area by a moment of inertia measured based upon the above premised conditions does not extend beyond one plane with respect to one axis of rotation, and one line on the face plane.

Figure 11:
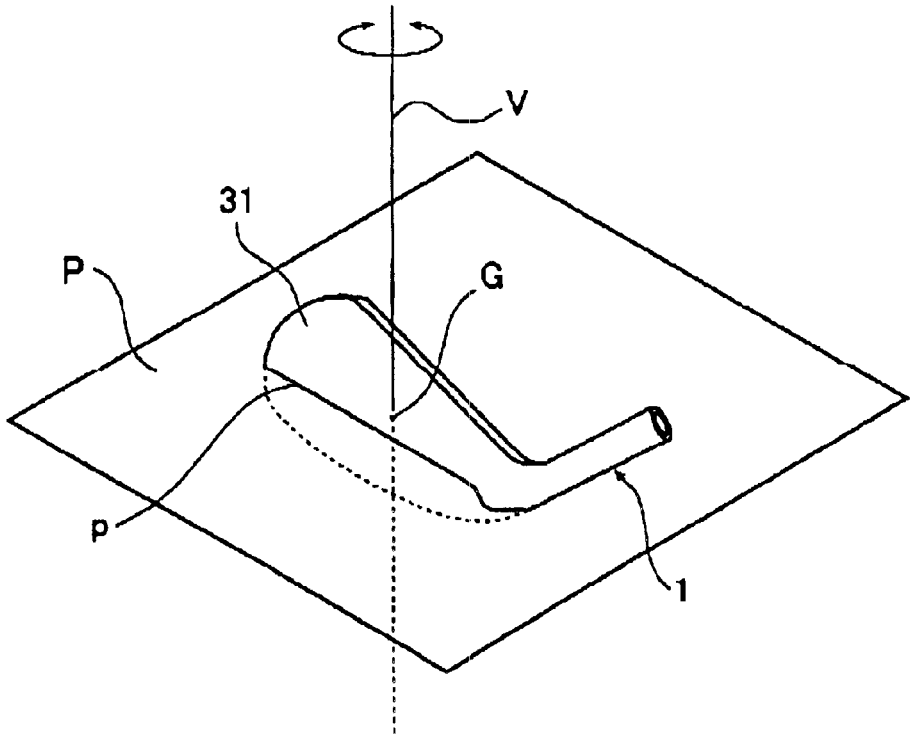
FIG.11 PRIOR ART
FIG. 11 is a perspective view diagram of a golf club head for explaining results obtained in accordance with a conventional method of measuring a moment of inertia.

Taking an easy explanation to understand, for example, the meaning of the moment of inertia about an axis V in a perpendicular direction and through the center of mass G of the golf club head 1 accurately shows only the movement for a case in which a force acts on a plane P containing the center of mass G. Expressed by hitting position on the face plane, this shows the complete motion of the golf club head only for a case on the line p at which the plane P and the face plane 31 intersect, namely a case of hitting while missing in the lateral direction with respect to the center of mass G. In other words, if a hit is not made just on the line p, there is movement of the golf club head in a direction other than around the axis, therefore the moment of inertia about the axis V in a perpendicular direction only indicates an expression for the size of the sweet area in the lateral direction on the line p. The curving of the line p at which the plane P and the golf club head 1 intersect is due to a hosel portion outside of the face plane 31, as shown in FIG. 11. In practice, the line p contacts the face plane 31 in a straight line portion.

On the other hand, the moment of inertia about an axis perpendicular to the face plane 31 and through the center of mass G of the golf club head 1 and which is measured in this embodiment, can be accurately indicates a numerical value of the size of the sweet area of the golf club head 1.

Conventionally, a means of peripheral distribution has been known as a basic means for making the size of the sweet area of a golf club head larger, and the term peripheral distribution denotes the distribution of mass in positions displaced rather far from the location of the center of mass of the golf club head. It is possible to increase the size of the sweet area of a golf club head having the same mass by distributing the mass to the periphery. Techniques such as making the golf club head of a wood golf club hollow, and making the golf club head of an iron golf club into a cavity back, are known as typical techniques for distributing the mass to the periphery.

The applicant of the present invention considers that among the techniques of peripheral mass distribution, as regards the face plane direction in particular, distribution of the mass at positions rather far from the center of mass of the golf club head, that is, peripheral distribution in the face plane direction indicates a connection with the expansion of the size of the sweet area of the face plane on which a golf ball is struck. As a result of wholehearted consideration, the moment of inertia about an axis perpendicular to the face plane and through the center of mass of the golf club head correctly expresses the extent of the peripheral distribution in the direction of the face plane. In other words, it indicates that the size of the sweet area of the face plane, the plane on which the golf ball is hit, is expressed accurately. This point is stated in detail in subsequent embodiments.

This type of moment of inertia about an axis perpendicular to the face plane 31 and through the center of mass G of the golf club 1 is one for accurately evaluating the size of the sweet area of the golf club, and it cannot be unconditionally said that it is preferable that this moment of inertia be large, as stated above.

In other words, although a golf club having a large sweet area may not make a lateral shift of the ball flight, and the ball flight distance may not drop much, even when the hitting position is variously varied, and although this type of golf club may certainly be suitable for ordinary golfers, for example beginners and intermediate golfers, among advanced golfers, techniques of hitting in the periphery of the sweet area, intentionally dropping the ball flight distance, and controlling the lateral shift of the hit ball, are preferred. There are golfers which use these techniques when challenging a golf course, and there is a tendency for golf clubs having a small sweet area to be suitable for these golfers. If the sweet area is large, the fact that there is little drop in ball flight distance even when the golf club is hit in the periphery of the sweet area, and the ball is not easily curved, and therefore is difficult to control, makes this type of club difficult to use for advanced golfers.

Considering the above points, the size of the moment of inertia measured in the present invention is not linked to an evaluation of how good performance or poor performance a golf club has. It mainly becomes a suitable index for evaluating for what type of golfer a specific golf club is suitable. Specifically, a golf club having a large moment of inertia of the present invention is suitable for golfers such as the following: a golfer seeking a stable feeling; a golfer seeking a straight ball flight; and, speaking with respect to golfer's subjective feel, a golfer seeking an easy feel (in which the golfer's hands do not become numb due to missing the sweet area). Furthermore, a golf club having a small moment of inertia of the present invention is suitable for golfers such as the following: a golfer seeking controllability; a golfer seeking to intentionally controlled (so as to curve) ball flight; and, speaking with respect to golfer's subjective feel, a golfer seeking a sharp feel (in which a very sharp response is felt by hitting on the sweet area).

Classification of the above given examples of golf clubs is not clearly divided into two types. Which type each golfer selects can be determined with the size of the moment of inertia of the present invention used as a criterion, and it is possible to determine which golf club is the most appropriate from golf clubs which have been prepared with several levels of classification. Of course, golfers who have moderate feeling and who do not point to either type can select a golf club having a moment of inertia of the present invention which is not large, and is not small, but rather is intermediate (normal).

For cases of comparing the size of the sweet area in accordance with the size of the moment of inertia in the present invention, it is preferable that the golf club heads have the same mass or nearly the same mass, or that they be a group of golf club heads. This is because the value of the moment of inertia is dependent upon mass. The term nearly the same mass denotes that the mass of each of the golf club heads, or the mass of each of the golf club heads in the group, exists within a range of 3% of the mass of the golf club head having the largest mass, preferably within a range of 2%, and more preferably within a range of 1%. However, this is for a case of pure comparison of the size of the moments of inertia of the present invention, and the method of evaluation of the present invention is not limited to comparisons in which the masses of the golf club heads are the same or are nearly the same, falling within the above range. For example, given three types of golf club heads A, B, and C, if the moments of inertia of the present invention indicate $I_A>I_B,>I_C$, and if the masses of the golf club heads are $M_A<M_B<M_C$, then the sizes of the sweet areas indicate A>B>C. Further, if the moments of inertia in the present invention are $I_A=I_B=I_C$, and if the masses of the golf club heads are $M_A>M_B,>M_C$, then the sizes of the sweet areas obviously indicate A<B<C. In this case, it does not matter whether or not the masses of A, B, and C fall within the above range. In other words, even when the masses are outside of the above range, if the moment of inertia of the present invention and the mass of the golf club are appropriately set, or if values obtained by dividing the moment of inertia in the present invention by the mass of the golf club heads are used, comparison of the size of the sweet areas in accordance with the method of evaluation of the present invention can be performed.

That is to say, with the present invention, provided that there is evaluation of a golf club in accordance with measuring the moment of inertia about an axis perpendicular to a face plane and through the center of mass of a golf club head, the evaluation may be made by using the measured values of the moment of inertia, and the evaluation may also be made by using values obtained by dividing the moment of inertia by the mass of the golf club head.

The size of the sweet area of a golf club can be evaluated in accordance with the method of evaluating a golf club of the present invention, but the measurement of the moment of inertia in the present invention is performed by using only the golf club head itself. The moment of inertia in the present invention is capable of being evaluated in the golf club head itself, but primarily the size of the sweet area must be used to evaluate the whole structure of a golf club, and the evaluation can be obtained after hitting a golf ball with the golf club. The size of the sweet area of the golf club is found in accordance with the moment of inertia of the present invention measured by the golf club head itself, and as a rule, does not change in accordance with changes in a golf club shaft or a grip. The moment of inertia of the present invention thus indicates the moment of inertia of the golf club head, and the sweet area indicates the sweet area of the golf club.

If evaluated golf clubs are thus classified into types in accordance with the moment of inertia of the golf club heads, this becomes a suitable aim for the golfer when selecting a golf club.

Golf club evaluation is performed based upon the moment of inertia in the present invention. Namely, golf clubs which are given a golf club evaluation in accordance with the value of the moment of inertia itself, or in accordance with the value obtained by dividing the moment of inertia by the mass of the golf club head, are provided to golfers with the present invention. These types of golf clubs according to the present invention are explained below.

A golf club of the present invention is one to which an evaluation is given after the golf club is classified by type, as stated above, in accordance with the method of evaluating a golf club of the present invention. Various embodiments can be given.

Figure 12:
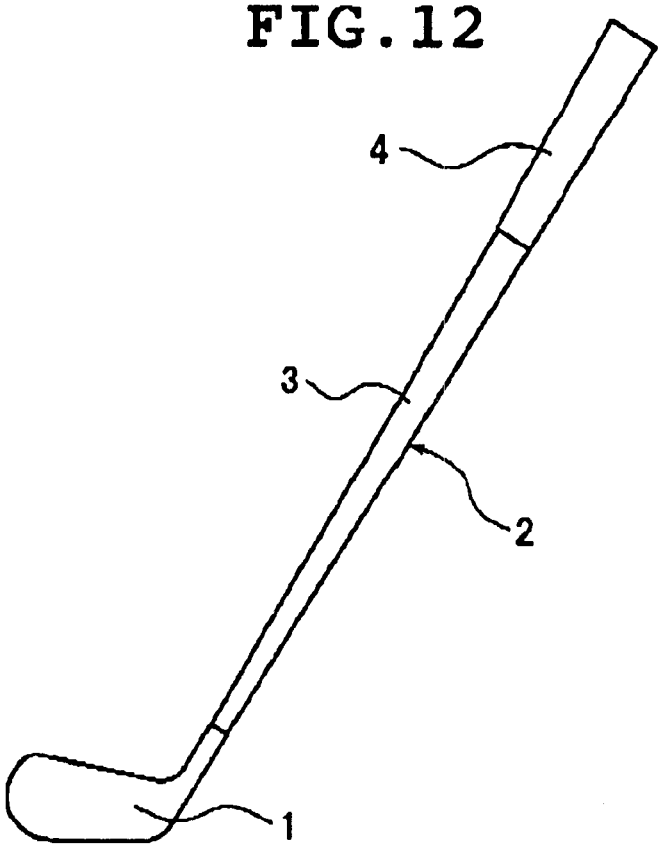
FIG. 12 is a front view diagram showing an embodiment of a golf club of the present invention.

First, an embodiment 1 of a golf club of the present invention is explained using a figure. FIG. 12 is a front surface diagram of a golf club relating to the present invention. A golf club 2 has the golf club head 1 installed at a leading tip portion of a golf club shaft 3, and a grip 4 on a trailing tip portion. A gripping portion which is a portion of the golf club shaft 3 may also be formed in the trailing tip portion. FIG. 12 is a diagram of a golf club used for right handed golfers, but the golf club of the present invention also includes those for left handed players, as well as for right handed players.

Figure 13A:
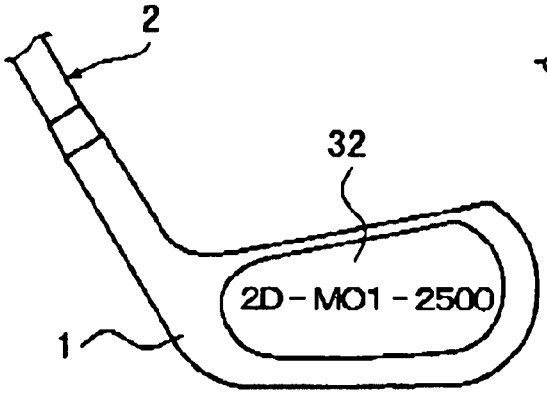
FIGS. 13A and 13B are enlarged back view diagrams of portions showing an embodiment of a golf club of the present invention.
Figure 13B:
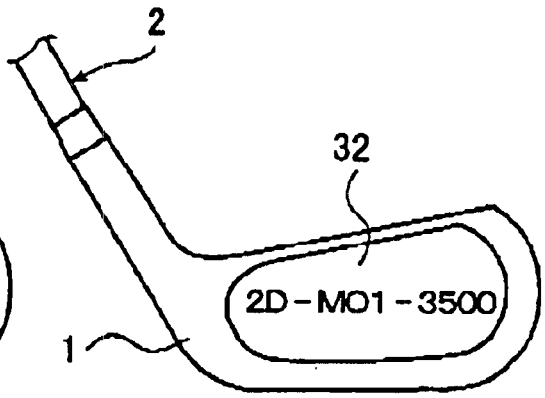

FIGS. 13A and 13B show examples of back surface views of golf clubs in which a club head portion of the golf club of FIG. 12 is enlarged. "2D-MOI 2500" is displayed in a back face portion 32 of the club head 1 in the golf club of FIG. 13A. The term "2D-MOI 2500" shows a numerical value ($g \cdot cm^2$) of a moment of inertia obtained by the method of evaluating a golf club of the present invention. Note that 2D-MOI is an abbreviation of 2-dimensional moment of inertia (the moment of inertia in two-dimensional directions of a face plane, namely the moment of inertia of the present invention). Golfers will recognize from the value 2500 that golf club displaying 2D-MOI 2500 is a club having a sharp feel; in other words, this is a small sweet area type golf club.

The golf club of FIG. 13B displays "2D-MOI 3500" in the back face portion 32 of the golf club head 1. The term "2D-MOI 3500" shows a numerical value ($g \cdot cm^2$) of a moment of inertia obtained by the method of evaluating a golf club of the present invention. Golfers will recognize from the value 3500 that golf club displaying 2D-MOI 3500 is a club having an easy to hit a golf club head, namely, the club having a large sweet area. It thus becomes possible for golfers to use moment of inertia information relating to the value of the moment of inertia, such as "2D-MOI 2500" and "2D-MOI 3500" as a criterion when selecting golf clubs. Of course, information relating to a value obtained by dividing the moment of inertia by the mass of the golf club head 1 may also be displayed on a portion of the golf club as a substitute for the moment of inertia value. Note that, in the various types of embodiments explained subsequently as well, information relating to the value obtained by dividing the moment of inertia by the mass of the golf club head in the present invention may also be used as a substitute for information relating to the moment of inertia value.

The term portion of the golf club in the present invention indicates a portion which is capable of being visually recognized, such as the golf club shaft, the golf club head, the grip, a socket (ferrule), a grip tip portion stop, a seal attached to the golf club shaft, or a seal attached to the golf club head.

The moment of inertia in the golf club of the present invention is a numerical value obtained by the method of evaluating a golf club of the present invention. The moment of inertia information relating to the value of the moment of inertia indicates information relating to the moment of inertia in the present invention. In addition to displaying actual measured values of the moment of inertia, numerical values determined by multiplying or dividing the actual values of the moment of inertia by a constant value may also be displayed. This is because the moments of inertia have significance not only in their absolute numerical values. Relating to comparison of the size of golf club sweet areas, provided that a relative relation between the size of the sweet area of the golf club and the moment of inertia value is maintained, it is possible to achieve the objective of the present invention, and numerical values obtained by multiplying or dividing the actual moment of inertia values by a constant value are also useful. Further, a combination of the actual value of the moment of inertia, or the numerical value obtained by multiplying or dividing the actual value by a constant value, with characters expressing the fact that the numerical value shows the moment of inertia of the present invention such as "2D-MOI 2500" or "2D-MOI 3500" may be used.

Further, the moment of inertia information in the present invention includes: values for displaying the moment of inertia of the present invention in levels, such as "1", "2", and "3" in Table 1; characters for displaying the moment of inertia of the present invention in levels, such as "Type A" and "Type B" in Table 2; and symbols for displaying the moment of inertia of the present invention in levels, such as "*" and "**" in Table 3. There are two or more levels, preferably 3 or more levels, and more preferably 4 or more levels.

TABLE 1

| Moment of inertia ($g \cdot cm^2$) | Value showing moment of intertia |
|---|---|
| Greater than or equal to 2000, and less than 2300 | 1 |
| Greater than or equal to 2300, and less than 2500 | 2 |
| Greater than or equal to 2600, and less than 3000 | 3 |
| Greater than or equal to 3000, and less than 3300 | 4 |
| Greater than or equal to 3300, and less than or equal to 3600 | 5 |

TABLE 2

| Moment of inertia ($g \cdot cm^2$) | Characters showing meoment of intertia |
|---|---|
| From 2400 to 2600 | Type A |
| From 2900 to 3100 | Type B |
| From 3400 to 3600 | Type C |

TABLE 3

| Moment of inertia ($g \cdot cm^2$) | Symbols showing meoment of inertia |
|---|---|
| 2300 | * |
| 2700 | ** |
| 3100 | *** |
| 3500 | **** |

The term display in levels denotes display divided into levels in accordance with moment of inertia ranges determined beforehand, as shown in Table 1, for corresponding the moment of inertia displayed on a portion of the golf clubs in the present invention to golf club types. In this case, the levels of display need not have the same range size through all levels. As shown in Table 1, the case of "1" is a value greater than or equal to 2000 $g \cdot cm^2$ and less than 2300 $g \cdot cm^2$, a range of 300 $g \cdot cm^2$; the case of "2" is a value greater than or equal to 2300 $g \cdot cm^2$ and less than 2600 $g \cdot cm^2$, a range of 300 $g \cdot cm^2$; the case of "3" is a value greater than or equal to 2600 $g \cdot cm^2$ and less than 3000 $g \cdot cm^2$, a range of 400 $g \cdot cm^2$; the case of "4" is a value greater than or equal to 3000 $g \cdot cm^2$ and less than 3300 g·cm2 a range of 300 $g \cdot cm^2$; and the case of "5" is a value greater than or equal to 3300 $g \cdot cm^2$ and less than or equal to 3600 $g \cdot cm^2$, a range of 300 $g \cdot cm^2$. The size of the ranges are not equal for all levels. It is possible for persons such as golf club manufacturers to suitably set the moment of inertia ranges for each level. Further, the numerals, characters, or symbols at both ends which show the smallest and the largest of the set levels may also be used only by one of the range values of the ends. For example, the case of "11" may be set to be moment of inertia values less than 2300 g·cm$^2$, and the "5" case may be set to be equal to or greater than 3300 g·cm$^2$.

Further, the moment of inertia coverage range for the display in levels may also be set such that the ranges are not continuous, as shown in Table 2. It is possible for the golf club manufacturers to remove ranges for the moment of inertia of the present invention which are not actually in use, thereby setting appropriate ranges which are discontinuous overall.

Furthermore, the moment of inertia in the present invention may be substituted with specific, characteristic numerical values not possessing a range, as shown in Table 3. Although specific, characteristic numerical values may be considered to be insufficient, actual finished products include normally allowable differences, and which are set within a range on the order of which there is no influence on the quality of the finished product. Therefore it is not necessary to display the actual moment of inertia values in the finished product while considering the allowable differences in particular. It is possible for the golf club manufactures to appropriately set the values such as finished product target values and center values as the characteristic numerical values of the moment of inertia in the present invention.

Further, moment of inertia information using numerals or symbols showing the moment of inertia of the present invention and reference information for obtaining evaluation information based on the moment of inertia information, namely reference information corresponding to the moment of inertia information and the golf club evaluation information, may also be integrally displayed in a portion of the golf club. The term reference information in the present invention indicates information which becomes a reference for recognizing the evaluation information found in accordance with the moment of inertia information of the present invention. For example, the performance of the golf club, such as impressing an easy feel in which the golfer's hands do not become numb even when missing the sweet area of the golf club, and a sharp feel in which a sharp response can be obtained by the golfers hands when the golf club is struck at its sweet area, may also be explained in accordance with a phrase, which is reference information based upon the present invention, as shown in FIGS. 14A to 14C.

It is preferable that the reference information includes a description which reflects the moment of inertia information of the present invention to the golf club performance, namely it is preferable that the reference information be a phrase describing the size of the sweet area. For example, in addition to the phrases "sharp" and "easy" shown in FIGS. 14A to 14C, the following can also be given: if the moment of inertia of the present invention is small, then phrases such as "hard", "solid", "gather spot", "muscle back", "recessed weight", and "tight center" may be used; if the moment of inertia is large, then phrases such as "sweet", "hollow", "wide spot", "cavity back", "surround weight", and "wide center" may be used. These phrases are mainly golf lingo, and the description indicating conceptually, by only the phrases themselves, the size of the sweet area of the golf club head. It becomes easy for golfers to recognize the evaluation information in accordance with the moment of inertia information of the present invention in accordance with the above phrases.

Figures 15A, 15B, 15C:
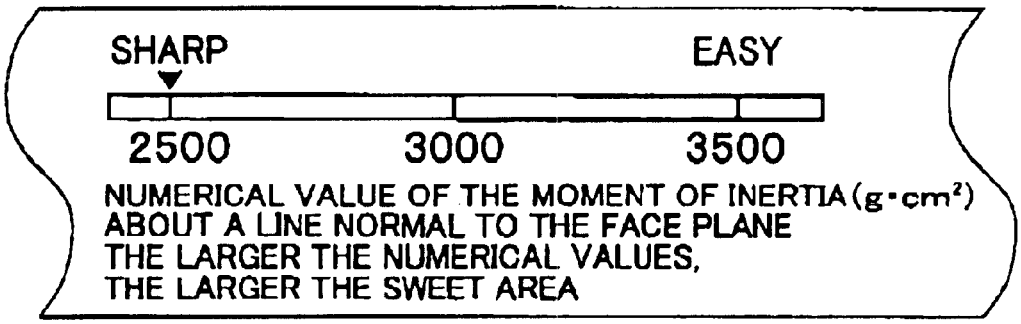
FIGS. 15A to 15C are enlarged planar view diagrams of portions showing another embodiment for displaying information in a portion of a golf club of the present invention.
Figure 16A:
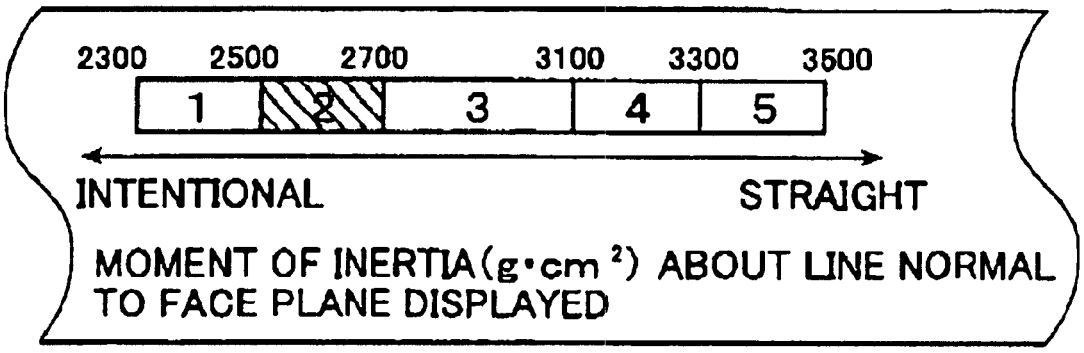
FIGS. 16A and 16B are enlarged planar view diagrams of portions showing another embodiment for displaying information in a portion of a golf club of the present invention.

The reference information may also explain by use of a drawing of the reference information based on the moment of inertia in the present invention, as shown in FIG. 15A, and may be explained by phrases as shown in FIG. 15B. The reference information may also be explained using a table of the reference information, as shown in FIG. 15C. The explanation may also be made by a drawing such as that shown in FIG. 16A, and the reference information may also be explained by combining two or more of the above.

Figure 16B:
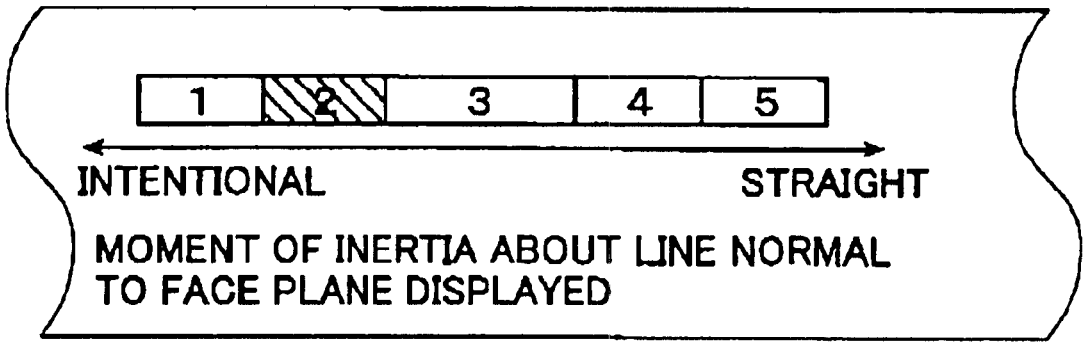

In addition, golf clubs which do not directly display the numerical value (g·cm$^2$) of the moment of inertia of the present invention, as shown in FIG. 16B, but with which the size of the sweet area of the golf club is evaluated by referring to the reference information in which the moment of inertia information of the present invention is expressed by a shaded area in FIG. 16B, are also included in the golf clubs of the present invention. Namely, golf clubs on which the golf club type is displayed based on the moment of inertia information which is not quantified and reference information of the present invention are also included in the golf clubs of the present invention.

In other words, if the moment of inertia of the present invention is not generally common knowledge, it is necessary to display reference information such as that shown in FIGS. 14A to 14C, FIGS. 15A to 15C, and FIG. 16A in order for the golfer to recognize what the value of the moment of inertia of the present invention is. If the moment of inertia of the present invention is generally common knowledge, then reference information may also be displayed with the omission of units of the moment of inertia, as shown in FIG. 16B, and with the omission of the display of reference information with the description, such as that of FIGS. 14A to 14C, FIGS. 15A to 15C, and FIG. 16A, and it is possible for golfers to recognize the moment of inertia of the present invention.

Further, if the moment of inertia of the present invention is even more so common knowledge, then even if only the moment of inertia information is displayed, as shown in FIGS. 13A and 13B, it is possible for golfers to recognize the moment of inertia of the present invention.

If the moment of inertia is extremely well known in general, then it is possible for golfers to recognize the moment of inertia information of the present invention from only the numerical value of the moment of inertia, and the "2D MOI 2500" shown in FIG. 13A can be shortened to "2500".

Furthermore, it is preferable to actually explain the values showing the moment of inertia of the present invention to golfers omitting detailed technical items for their understanding. In other words, content such as the measurement apparatus and the measurement conditions need not be included in the explanation content. It is preferable that these types of measurement conditions be standardized between golf club manufacturers, and that the explanation is briefed to the extent that golfers can recognize that the larger the moment of inertia of the present invention, the larger the sweet area becomes. In particular, it is preferable that short phrases suitably combining easily recognizable words, numerals, symbols, and diagrams be used in order to display the reference information on a portion of the golf club.

As explained above, a golfer sees the moment of inertia information of the present invention or reference information in order to obtain the moment of inertia information of the present invention and evaluation information based on the moment of inertia information, which are displayed on the golf club. The golfer then can select a golf club which conforms to the golfer's desired ball flight and feeling when he hits a golf ball among golf clubs displaying this information.

Note that, although the above examples are ones in which moment of inertia information and reference information are displayed integrally on a portion of the golf club, the moment of inertia information and the reference information may also be displayed separately on a portion of the golf club in the present invention. For example, the moment of inertia information may be displayed on the golf club head, and the reference information maybe displayed on a seal attached to the golf club shaft. In addition, the moment of inertia information may be displayed on the golf club head and the reference information may be displayed on a tag and the like attached to the golf club. At minimum, the reference information for obtaining the golf club evaluation information based upon the moment of inertia information should be displayed in a position which is easy to refer to.

Another embodiment relating to a golf club of the present invention is explained using figures.

FIGS. 17A to 17C are golf clubs relating to the present invention (portions of golf club shafts are omitted). Numerals "2500" are displayed in a golf club head of the golf club of FIG. 17A, along with a golf club brand name "ABCD" displayed on the golf club shaft. In addition, numerals "3000" are displayed in a golf club head of the golf club of FIG. 17B, along with the golf club brand name "ABCD" displayed on the golf club shaft. On the golf club of FIG. 17C, numerals "3500" are displayed in a golf club head along with the golf club brand name "ABCD" displayed on the golf club shaft.

FIG. 17D shows an external display medium M in which the explanation relating to the numerals displayed is shown along with the golf club brand name "ABCD" shown in FIGS. 17A to 17C. An explanation of characters capable of specifying a golf club such as a golf club brand name "ABCD series" are displayed in the external display medium M, and the explanation is such that the values displayed on the golf club, "2500, 3000, 3500" are moment of inertia information relating to the value of the moment of inertia of the present invention. Further, reference information for obtaining the evaluation information based on the moment of inertia information of the present invention, namely that the "2500" sweet area is "small", the "3000" sweet area is "normal", and the "3500" sweet area is "large", is displayed. It becomes possible for golfers to understand the meaning of the values showing the moment of inertia of the present invention by the explanation shown in the external display medium M. It becomes possible for golfers to select a golf club showing these displayed values as a criterion in the external display medium M. Specifically, it becomes possible for golfers to select a golf club on which the same values are noted as those of the golf clubs shown in the external display medium M. Further, the term "sweet area display system" shown in the external display medium M of FIG. 17D denotes an example of sales talk relating to the moment of inertia of the present invention, and such naming may be suitably determined by the golf club manufacturer or a sales corporation.

The term external display medium M can be considered to denote an explanation pamphlet or catalog put out by the golf club manufacturer or the sales corporation, a poster or display panel displayed at a store, a picture of a TV commercial, a picture of sales promotion video, or a picture displayed by using electric communication circuit. Namely, the term external display medium M denotes one means of display which is mainly capable of being recognized visually, explains the moment of inertia information of the present invention, and displays the reference information explicitly shown on the golf club for displaying the moment of inertia information. It is necessary for the external display medium M to display the reference information shown in FIG. 11D if the moment of inertia of the present invention is not generally common knowledge. If the moment of inertia is common knowledge, display of the reference information in which the units of the moment of inertia are omitted or the values of the moment of inertia are classified instead of omitting the values can be considered. Both are included within the present invention. In order to actually explain the values showing the moment of inertia of the present invention to golfers, it is preferable to omit detailed technical items for golfer's understanding. In other words, it is not necessary in particular to include the measurement apparatus and the measurement conditions and the like in the explanation. It is preferable that these types of measurement conditions be standardized between golf club manufacturers, and that the explanation is briefed to the extent that golfers can recognize that the larger the moment of inertia of the present invention, the larger the sweet area becomes. In particular, in order to explain the moment of inertia information of the present invention displayed on the golf club in accordance with the external display medium, it is preferable that diagrams and photographs of the corresponding golf clubs be used as the explanation copy for easy understanding.

As explained above, a golfer sees the moment of inertia information displayed on the golf club and the tables for respective types displayed on the external display medium. The golfer then can select a golf club which conforms to the golfer's desired ball flight and feeling when he hits a golf ball among golf clubs displaying the moment of inertia information.

Another embodiment relating to a golf club of the present invention is explained using figures.

FIGS. 18A to 18D are perspective views showing golf clubs relating to the present invention. The golf club shown in FIG. 18A displays a golf club formal name "BCDE M443", and the golf club of FIG. 18B displays a golf club formal name "BCDE M433". In addition, the golf club of FIG. 18C displays a formal name "BCDE M423", and the golf club of FIG. 18D displays a formal name "BCDE M413".

The golf club formal names indicate a golf club classification of a golf club manufacturer used for sales. Namely, golf clubs or a golf club set having identical models have the same performance. In addition, the model name is also referred to as type name, or product number, or nearly all conventional golf clubs are given such.

Figure 18E:
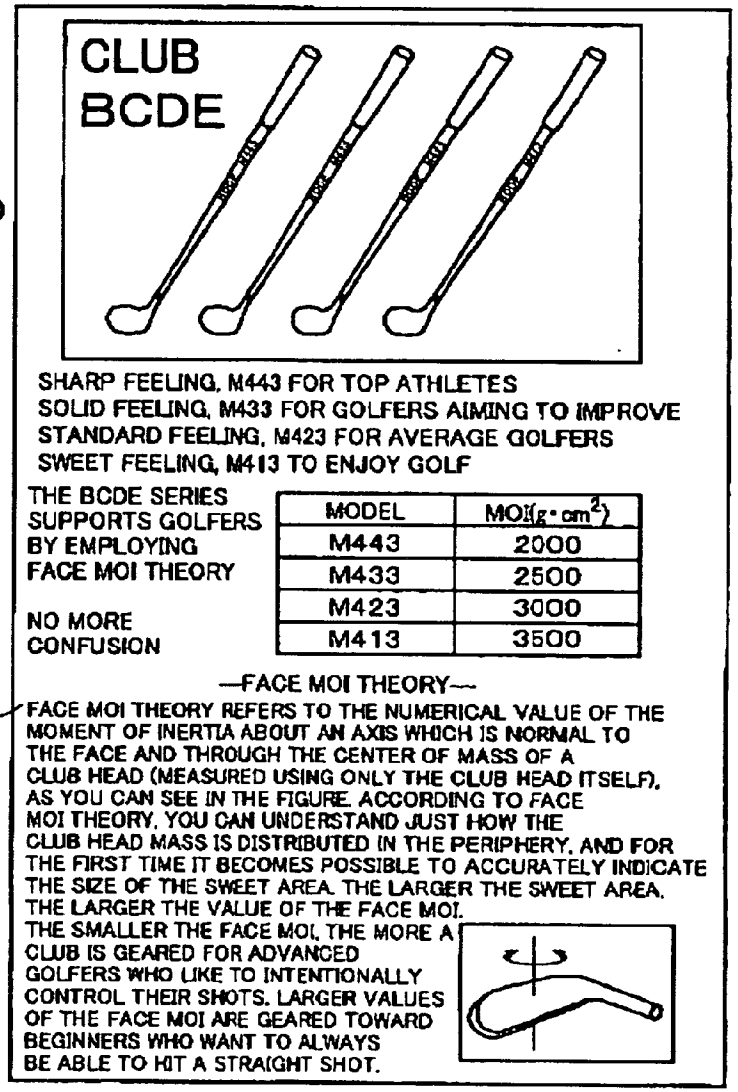
FIG. 18E is a diagram showing an example of the display contents of an external display medium for recognizing the characteristics of a golf club of the present invention.
Figures 18A, 18B, 18C, 18D:
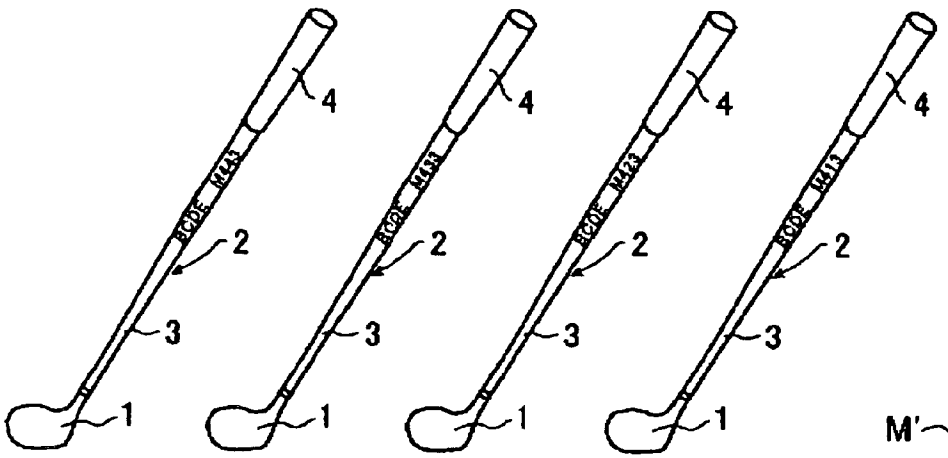
FIGS. 18A to 18D are enlarged planar view diagrams of portion showing another embodiment of a golf club of the present invention.

FIG. 18E shows an external display medium M' for explanations relating to the golf club with model names of "M443, M433, M423, and M413" of the brand name "BCDE" shown in FIGS. 18A to 18D.

Characters or the like capable of specifying a golf club, such as the golf club brand name and model name, "club BCDE" and "BCDE M443, BCDE M433, BCDE M423, and BCDE M413" are displayed in the external display medium M'. Further, moment of inertia information corresponding to the golf club model, such as the moment of inertia of M443 is 2000, the moment of inertia of M433 is 2500, the moment of inertia of M423 is 3000, and the moment of inertia of M413 is 3500, is displayed along with reference information corresponding to the golf club model, such as "sharp feeling, M443 for Top Athletes", "solid feeling, M433 for Golfers aiming to improve", "standard feeling, M423 for Average Golfers", and "sweet feeling, M413 to enjoy golf". It becomes possible for golfers to select a golf club showing these displayed values in the external display medium M' as a criterion. Specifically, it becomes possible for golfers to select a golf club on which the same models are noted as those of the golf clubs shown in the external display medium M'. Further, the term "face MOI theory" shown in the external display medium M' of FIG. 18E denotes an example of sales talk relating to the moment of inertia of the present invention, and such naming may be suitably determined by such as the golf club manufacturer or the sales corporation.

The term external display medium M' can be considered to denote an explanation pamphlet or catalog issued or made by such as the golf club manufacturer or the sales corporation, or such as a poster or display panel displayed at a store, or a picture of a TV commercial, a picture of sales promotion video, or a picture displayed by using an electric communication circuit. Namely, the term external display medium denotes one means of display which is mainly capable of being recognized visually, explains the moment of inertia information of the present invention, and displays the reference information relating to the golf clubs based on the moment of inertia information. It is necessary for the external display medium M' to display the moment of inertia information and the reference information shown in FIG. 18E if the moment of inertia of the present invention is not generally common knowledge. If the moment of inertia information is common knowledge, display of the reference information in which the units of the moment of inertia are omitted or the value of the moment of inertia is classified instead of omitting the values can be considered. If it becomes further a known common knowledge, only the moment of inertia information may be displayed. Both are included within the present invention.

In order to actually explain the values showing the moment of inertia of the present invention to golfers, it is preferable to omit detailed technical items for understanding. In other words, it is not necessary in particular to include the measurement apparatus and the measurement conditions in the explanation. It is preferable that these types of measurement conditions be standardized between golf club manufacturers, and that the explanation is briefed to the extent that golfers can recognize that the larger the moment of inertia of the present invention, the larger the sweet area of the golf club becomes. In particular, in order to explain the moment of inertia information of the present invention displayed on the golf club in accordance with the external display medium, it is preferable that diagrams and photographs of the corresponding golf clubs be used with the explanation copy for easy understanding.

As explained above, a golfer sees reference information in order to obtain the moment of inertia information of the present invention, or the moment of inertia information of the present invention and evaluation information based on the moment of inertia information. The golfer then can select a golf club model which conforms to the golfer's desired ball flight and feeling when he hits a golf ball from among the golf clubs displaying this information.

It has been thus stated that selection of a golf club suitable for an individual can be made based on the moment of inertia information relating to the value of the moment of inertia around an axis perpendicular to the face plane, and through the center of mass of the golf club head, displayed on the golf club. That this moment of inertia is more accurate and appropriate as a parameter for indicating the site of the sweet area, compared to a moment of inertia about an axis in a horizontal direction, conventionally measured and used for evaluation, is explained based on a subsequent Example A.

All of the above explanations relate to the value of the moment of inertia of one golf club or to moment of inertia information based upon this value, but golf is a game in which golfers use a plurality of golf clubs at most fourteen golf clubs, having differing lengths and loft angles.

In the case of irons, for example, in order to hit accurate shots and carry a golf ball around the pin, iron type golf clubs are demanded in characteristics in which the ball flight distance is controlled accurately in accordance with the number of the iron.

A golf club set, in which a plurality of golf clubs having differing loft angles and club lengths, are adjusted in an adequate balance for controlling ball flight distance is also provided by the present invention.

Figure 20:
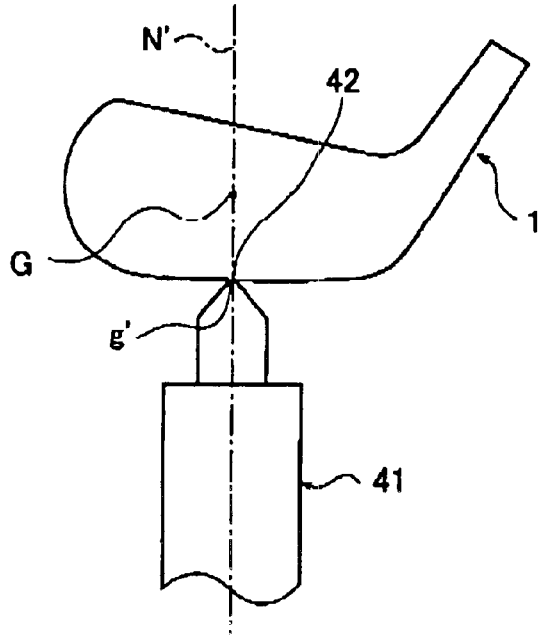
FIG. 20 PRIOR ART
FIG. 20 is a diagram showing a conventional state of center of mass measurement in order to measure a moment of inertia.

FIG. 20 shows a golf club set 100, one embodiment of a golf club set of the present invention.

The golf club set 100 is composed of ten irons A3 to AS, iron club numbers from a number 3 iron A3 to a number 9 iron A9, a pitching wedge AP, an approach wedge AA, and a sand wedge AS. Each iron has a grip 104 at one end of a golf club shaft 102, and a golf club head 106 is prepared at the other end. The golf club head 106 is coupled to the golf club shaft 102 in which a hosel 108 extending upward on the heel side of the golf club head 106 is linked to a socket 110 of the golf club shaft 102.

The term golf club number is a term containing identifying information relating to the order of loft angle, and is expressed by such as numerals, characters, and symbols given to each golf club so that the golf clubs, mainly differing by loft angle, can be arranged in order of their loft angle. The loft angle of each golf club number is suitable set by persons ordinary skilled in the art at a constant or nearly constant interval. Further, the term large club number indicates a club number having a large loft angle.

The loft angles θ (degrees) of the irons A3 to AS are set so that the loft angle θ (degrees) becomes larger with larger club numbers, as follows: the loft angle of the iron A3 is 21°, the loft angle of the iron A4 is 24°, A5 is 27°, A6 is 30°, A7 is 34°, A8 is 38°, A9 is 42°, AP is 47°, AA is 52°, and the loft angle of the iron AS is 57°. The golf clubs in which the loft angle θ is greater than or equal to 16° and less than or equal to 41° includes six clubs, irons A3 to A8. Note that the loft angles of the irons A3 to AS becomes larger by an interval of 3 degrees per club from A3 to A6, becomes larger by a step width of 4 degrees per club from A7 to A9, and becomes larger by an interval of 5 degrees per club from AP to AS. However, the step widths between the loft angles of the irons A3 to AS are not limited to these, and a constant interval of such as 3 or 4 degrees may also be used.

Further, the length from the tip portion of the grip 104 to the lower end of the golf club head 106 (the club length) may become shorter with increasing golf club numbers.

Note that, although the above embodiment is one in which ten irons form the golf club set, the golf club set of the present invention is not limited to only an iron golf club set. The golf club set of the present invention is composed of golf clubs having different loft angles θ (degrees), including wood golf club set, a golf club set which breaks down the boundaries between a wood golf club set and an iron golf club set, a golf club set having only several clubs corresponding to long irons and a golf club set containing so-called utility clubs having intermediate performance between wood golf clubs and iron golf clubs, and which are difficult to classify.

Figure 21:
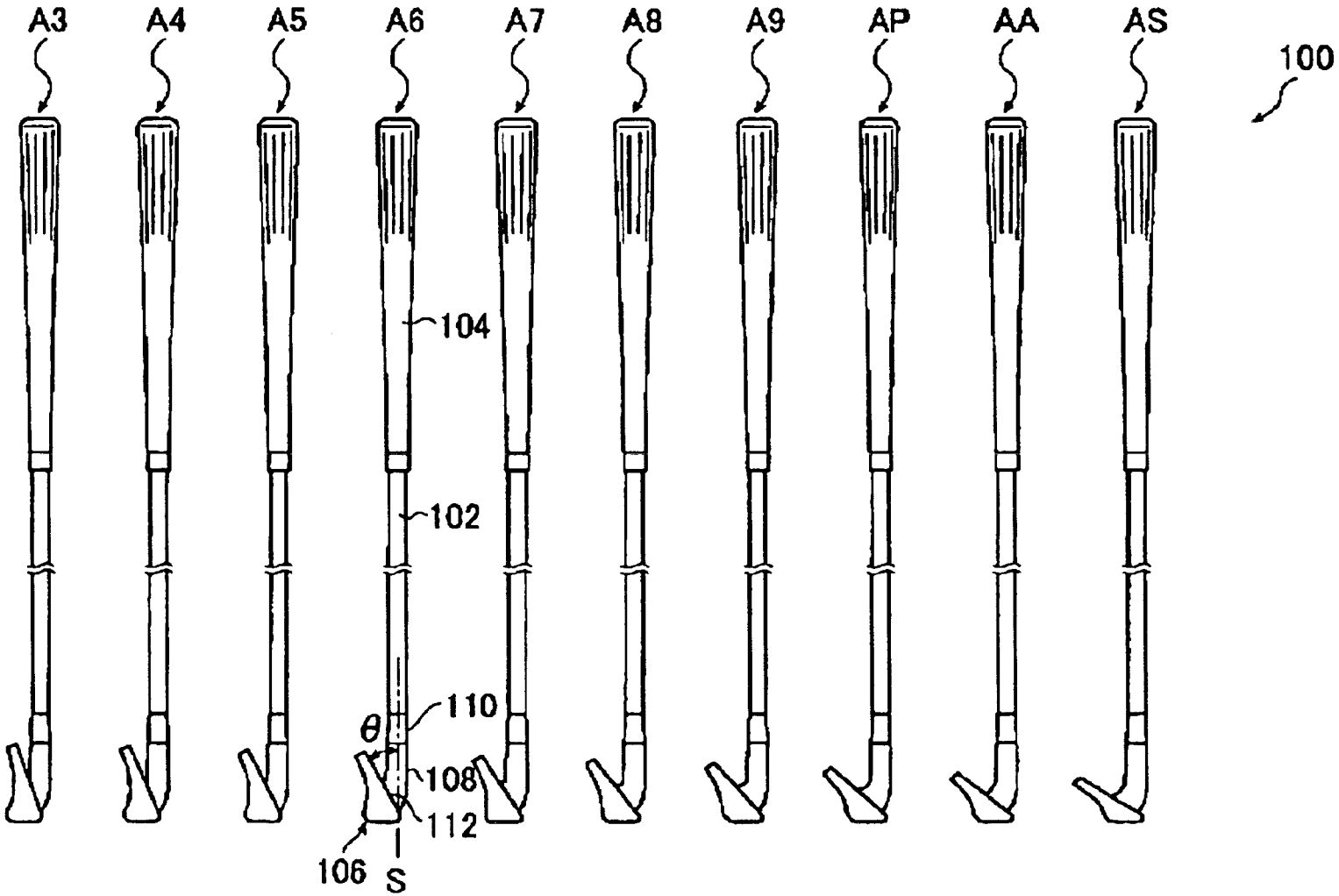
FIG. 21 is a side view diagram showing the exterior of a golf club set which is one example of a golf club set of the present invention.
Figure 22:
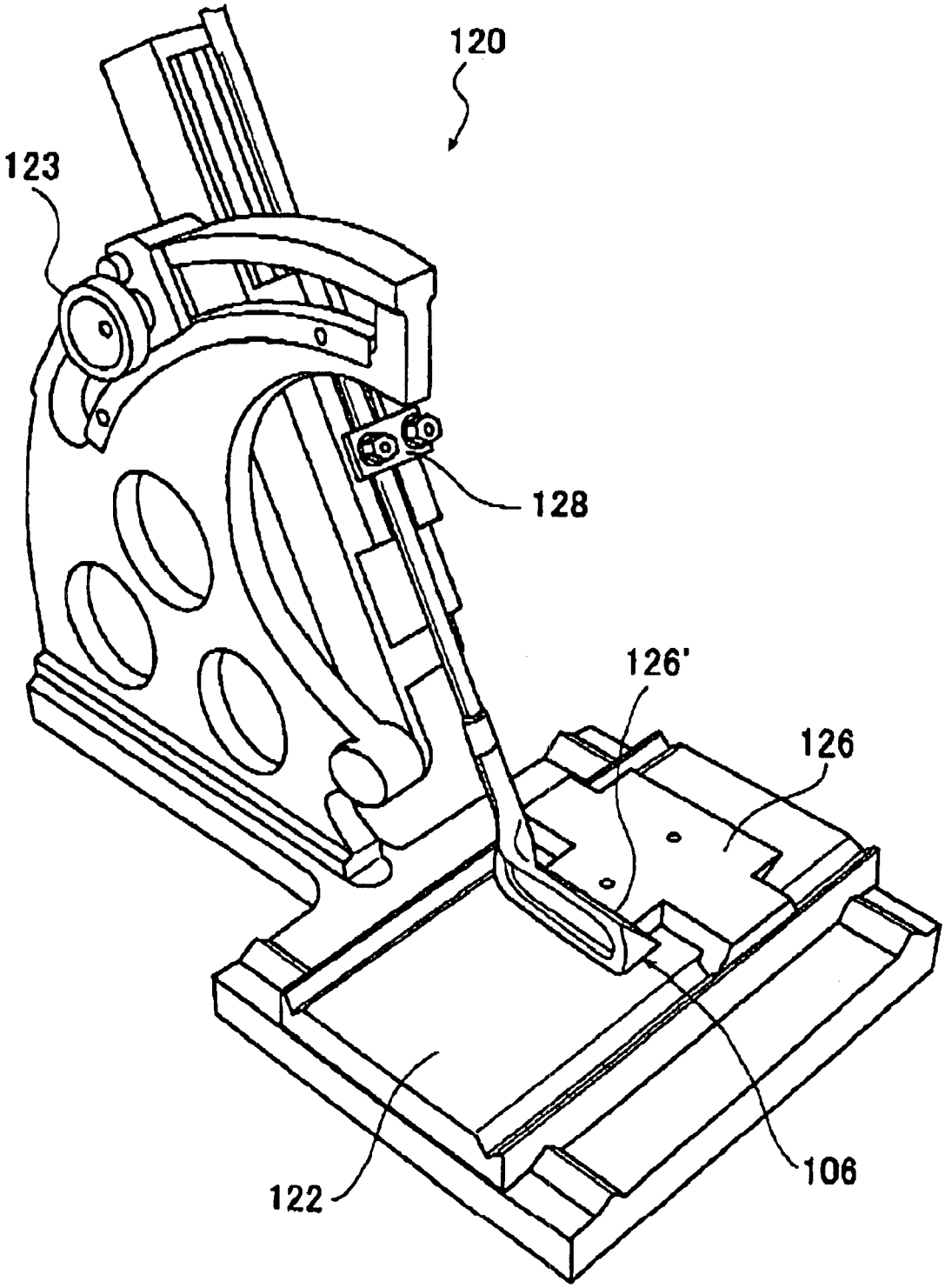
FIG. 22 is a schematic perspective diagram of a measurement apparatus for measuring the loft angle of each golf club of a golf club set of the present invention.
Figure 23:
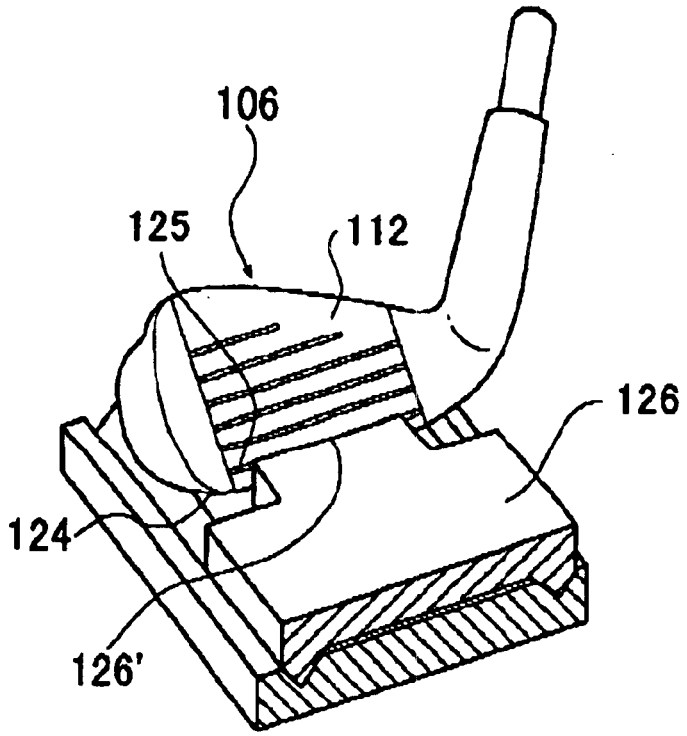
FIG. 23 is an explanation diagram for explaining main portions of the measurement apparatus shown in FIG. 22.
Figure 24:
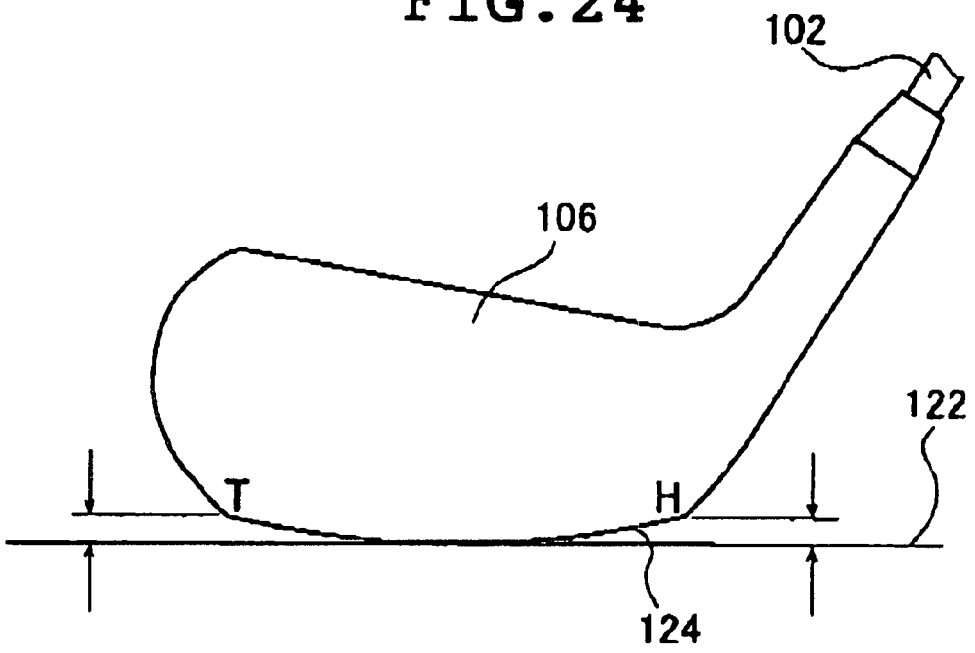
FIG. 24 is an explanation diagram for explaining a method of measuring a loft angle by the measurement apparatus shown in FIG. 22.

The term loft angle θ (degrees) is the angle formed between a shaft axis S and a face plane 112, as shown for the iron A6 in FIG. 21, and is measured by a loft angle measurement apparatus 120 such as that shown in FIG. 22. FIG. 22 shows an example of placing the iron A6 to the loft angle measurement apparatus 120, and FIG. 23 shows an enlargement of the periphery of the golf club head 106 of FIG. 22.

Measurement of the loft angle θ is performed with the golf club (the iron A6) in a state of being disposed to the loft angle measurement apparatus 120. The attachment angle is adjusted in a lie angle adjustment portion 123 so that the iron A6 is seated along its lie angle with respect to a standard plane 122. The golf club (the iron A6) disposed to the loft angle measurement apparatus 120 is next fixed to a chuck portion 128 such that a sole portion 124 contacts the standard plane 122, and such the standart plane 122 is in close contact with a leading end portion 126' of a face angle adjustment jig 126. Namely, that the golf club (the iron A6) is fixed to the chuck portion 128 such that the face angle becomes 0°.

The term seated along the lie angle denotes seating such that score lines 125 become parallel with the edge of the leading end portion 126' of the face angle adjustment jig 126. Further, in a case it is difficult to make distinctions by using the score lines because they are not straight lines or the like, then if the sole portion 124 becomes rounded into a convex shape between a toe side T and a heel side H, then the golf club is seated such that a gap which develops between the standard plane 122 and the sole portion 124 is nearly equal at the toe side and the heel side.

Figure 25:
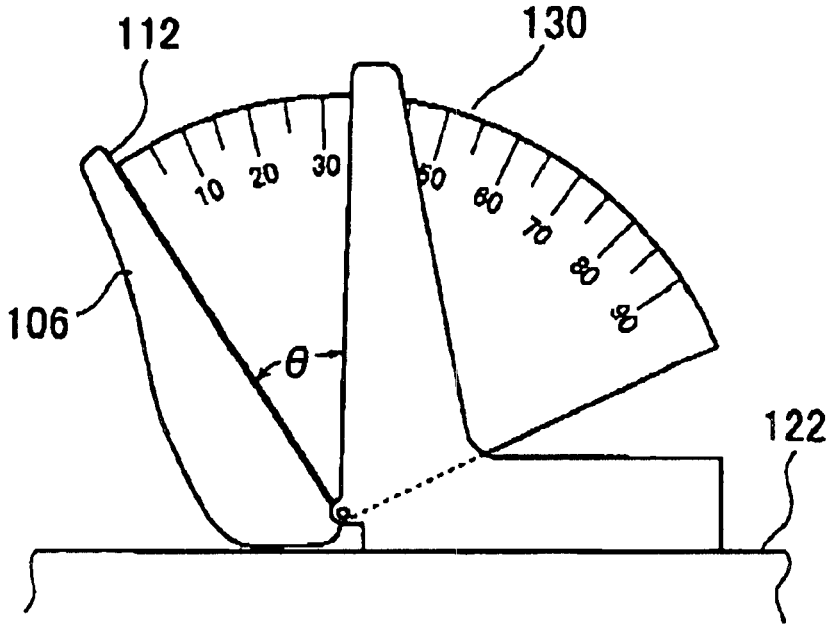
FIG. 25 is another explanation diagram for explaining a method of measuring a loft angle by the measurement apparatus shown in FIG. 22.
Figure 26:
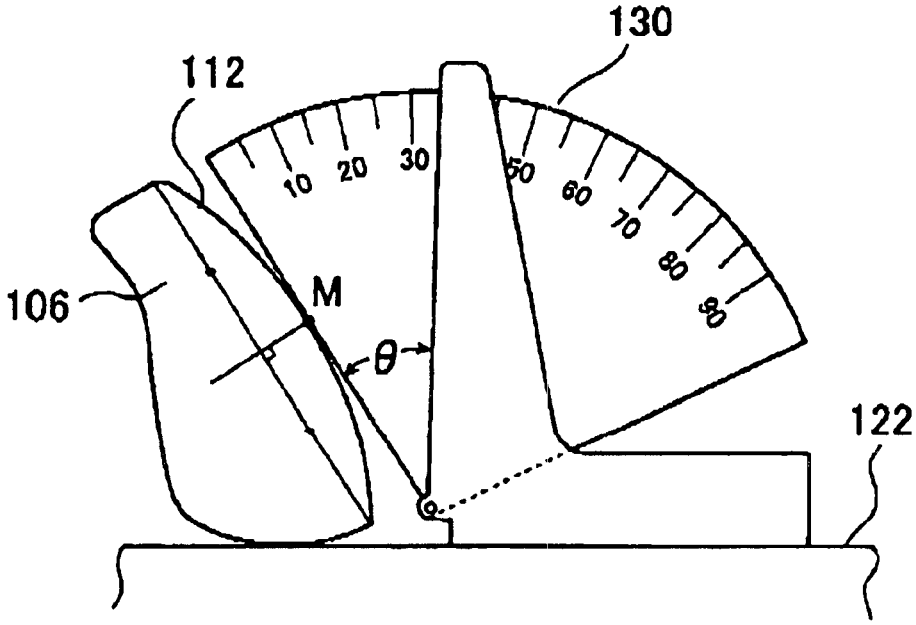
FIG. 26 is another explanation diagram for explaining a method of measuring a loft angle by the measurement apparatus shown in FIG. 22.

Next, as shown in FIG. 25, the loft angle θ of the face plane 112 of the golf club head 106 is measured using a protractor 130 standing perpendicular to the standard plane 122. If the face plane 112 is planar, then the loft angle θ is obtained in accordance with the above measurement, but if the face plane 112 is rounded into a convex shape, then the measurement is made as shown in FIG. 26 by placing a center point M of the fare plane 112 in contact with the measurement surface of the protractor 130.

In addition to measuring the golf club, as stated above, it is also possible to measure the loft angle θ by inserting a shaft pin into a golf club head alone, and then performing measurement. The numerical value of the loft angle θ obtained by measuring the golf club head by itself is substantially the same as the loft angle θ obtained by the above stated golf club measurement.

A known measurement device available on the market may be used for this type of measurement apparatus, such as, for example, a GOLF CLUB HEAD GAUGE (manufactured by Sheng Feng Company (TAIWAN)), a golf club angle measurement apparatus (manufactured by golf garage), and a golf club gauge (manufactured by Golfsmith).

Among all of the golf clubs A3 to AS of the golf club set 100 thus measured, the golf clubs having a loft angle θ equal to or greater than 16° and less than or equal to 41°, are the golf club numbers A3 to A8. The size of the moments of inertia is adjusted corresponding to the golf club number, as explained below, for each of the golf club numbers having a golf club loft angle θ equal to or greater than 16° and less than or equal to 41°, namely the golf clubs A3 to A8. The reason for adjustment of the size of the moment of inertia is because the golf clubs having loft angles θ within a range equal to or greater than 16° and less than or equal to 41° are, in particular, clubs with which there is a demand to control ball flight distances accurately. Changes in the flight distance which develops when controlling the ball flight distances can be regulated by the size of the moment of inertia.

On the other hand, driver type clubs having a loft angle θ less than 16°, and wedge type clubs having a loft angle θ greater than 41°, are often purchased not as part of a set, but as individual clubs. As can also be understood from the fact that golf club manufacturers and suppliers aggressively market these clubs as single items, golf clubs having a loft angle θ less than 16° are mainly clubs for hitting a golf ball teed up and gaining flight distance, and there is not always a demand for these clubs to be included within the golf club set such that ball flight distance is able to be controlled. On the other hand, golf clubs having a loft angle θ which exceeds 41° are often clubs used for controlled approach shots in order to place the golf ball on the green with certainty by adjusting swing power. Further, these clubs are ones which have the shape of their sole portion and the contour shape of their face improved so that approach shots are easy to hit, and therefore there is not necessarily a demand to have these clubs included within the golf club set such that ball flight distance is able to be controlled.

Further, it is necessary that the number of golf clubs composing the golf club set be at least equal to or greater than 3 in the present invention, and preferably there are three or more golf clubs having with a loft angle θ within a range equal to or greater than 16° and less than or equal to 41°. On the other hand, there is no particular maximum limit on the number of golf clubs in the golf club set; however, the maximum number of golf clubs which can be carried is determined by the rules of golf competition, and it is thus preferable that the number of golf clubs in the golf club set is equal to or less than fourteen.

Each golf club structuring the golf club set 100 has a moment of inertia about an axis perpendicular to the face plane of the golf club and through the center of mass of the golf club head adjusted, as shown below, corresponding to the numerical order of the golf club number.

Conventionally, the sweet area of a golf club is characterized by two moments of inertia, a moment of inertia about an axis which is parallel to the hitting plane and through the center of mass of the golf club head, and which is horizontal, and a moment of inertia about an axis which is vertical through the center of mass, as stated above. These moments of inertia express the displacement or movement of the golf club head when hitting a golf ball while missing the sweet area up and down in a vertical direction, or while missing the sweet area in a toe and heel direction, respectively, but the size of the sweet area cannot be unambiguously evaluated by the two moments of inertia. They cannot therefore be made into an indicator for variations in the golf ball flight distance.

However, the moment of inertia is measured about an axis having a direction of impact imparted to a golf ball on the face plane of the golf club when hitting the golf ball, namely having a direction perpendicular to the face plane of the golf club in the present invention, and therefore the size of the sweet area of the face plane of the golf club head can be unambiguously expressed. What's more, the moment of inertia can be adjusted corresponding to the numerical order of the golf club number, and therefore the size of the sweet area of the face plane of the golf clubs is adjusted corresponding to the golf club number.

This type of moment of inertia adjustment may be performed by a known method such as a method of distributing mass in a golf club head, and the moments of inertia are adjusted so as to change nearly linearly corresponding to golf club number order. More specifically, the irons A3 to A8 are expressed by continuous natural numbers X, in order beginning from the smallest club number and starting with X=1, namely the iron A3 has X=1, the iron A4 has X=2, . . . , and the iron A8 has X=6. On the other hand, with the moments of inertia taken as Y ($g \cdot cm^2$), the moments of inertia Y are plot onto a straight line, or are set so as to be contained within a region interposed between two parallel straight lines determined by Eq. (1). A coefficient a determines the slope of the straight lines, and a coefficient b is determined by the value of the coefficient a and by correspondence to all plot positions.

In addition, the moment of inertia Y of each golf club number of the golf club set 100 is set such that the coefficient a of Eq. (1) is equal to or less than 60, or is greater than 60.

For a golf club set having the coefficient a of Eq. (1) greater than 60, the moments of inertia Y become larger with respect to the numerical order of the golf club number. This golf club set is effective for golfers who prefer hitting shots such that the ball flight be controlled by utilizing curve of the golf ball flight with long irons such as the number 3 iron and the number 4 iron, which have small loft angles θ, and on the other hand, who prefer that the relative amount of curve of the golf ball flight when struck by the golf clubs having large club numbers, namely ones having large loft angles θ, be suppressed. It is preferable that the coefficient a be equal to or greater than 65, and more preferably that the coefficient a be equal to or greater than 70. Furthermore, it is preferable that the coefficient a be less than or equal to 140, and more preferably, that the coefficient a be less than or equal to 135.

When the coefficient a of Eq. (1) is equal to or less than 60, the size of the moment of inertia Y does not change much even for different golf club numbers, and this becomes a structure in which the golf clubs possess a uniform moment of inertia Y which is relatively large. This is effective for golfers who prefer to hit shots in which curve of the golf ball flight by the golf clubs having large loft angles θ is suppressed, and who prefer to hit shots in which curve of the golf ball flight is relatively suppressed even in long irons such as the 3 iron and the 4 iron, which have small loft angles θ. It is preferable that the coefficient a be equal to or less than 55, and it is more preferable that the coefficient a be equal to or less than 50. Furthermore, it is preferable that the coefficient a be greater than or equal to −20, and more preferably, that the coefficient a be grater than or equal −15.

The moments of inertia Y are thus adjusted with respect to each golf club number of the golf club heads 112 in accordance with setting coefficient a of Eq. (1) and setting coefficient b in accompaniment with coefficient a. Based on this, the size of the sweet area of the face plane can then be unambiguously determined in accordance with a known method of distributing mass or the like, and variation in the ball flight distance of each golf club number within the golf club set can be harmonized.

Golf club sets having the coefficient a of Eq. (1) greater than 60 are generally positioned as golf club sets preferred by advanced golfers, but it is not necessarily appropriate for advanced golfers to select this type of golf club set. Even advanced golfers, provided that they are golfers who want to suppress curve of their golf ball flight for each gold club number, may select a golf club set with a value of the coefficient a of Eq. (1) equal to or less than 60 without a problem. A golf club set may be selected to suit one's ability, one's personal preference in a golf ball flight for each golf club number, one's preferred strategy, and by one's preferred feel.

Note that the values of the moments of inertia Y set by Eq. (1) are contained within a range interposed by two parallel straight lines, $Y=a \cdot X+b$ and $Y=a \cdot X+b+50$, preferably within a range interposed by two parallel straight lines, $Y=a \cdot X+b$ and $Y=a \cdot X+b+35$, and more preferably within a range interposed by two parallel straight lines, $Y=a \cdot X+b$ and $Y=a \cdot X+b+20$. With the present invention, it is sufficient that one combination of the coefficients a and b exist such that every point when the moments of inertia Y are plotted with respect to X is contained within a range interposed by the above two straight lines. Note that, there are no particular limitation placed on the value of the coefficient b.

Further, it is preferable that the value of the moments of inertia Y be equal to or greater than 1500 ($g \cdot cm^2$). This is because the sweet area of the golf club heads can be ensured to a certain extent if the value of the moments of inertia Y be equal to or greater than 1500 ($g \cdot cm^2$), and because variation in the golf ball flight distance does not become extremely large due to dispersion of hitting point. Further, there is no particular maximum value set for the moments of inertia, but a limit on the order of 5000 ($g \cdot cm^2$) can be considered due to the golf club head materials, the manufacturing technology, and the golf ball size.

By thus adjusting the moment of inertia Y to change in a nearly linear manner with respect to the numerical order of the golf club number, the size of the sweet area changes continuously and smoothly with respect to the numerical order of the golf club numbers, and therefore a tendency of the variation in golf ball flight distance can be given to each golf club.

Note that, as a substitute for expressing the irons A3 to A8, those from among the golf clubs of the golf club set 100 having a loft angle equal to or greater than 16° and equal to or less than 41°, by continuous natural numbers X beginning with X=1 starting from the lowest golf club number, with the present invention the irons A3 to A8 may also be expressed by the loft angle θ (degrees), and the moment of inertia about an axis perpendicular to the face plane and through the center of mass of the golf club head may be adjusted corresponding to the size of the loft angle θ.

For example, the moments of inertia Y about an axis perpendicular to the face plane and through the center of mass of the golf club head for loft angles 0 equal to or greater than 16° and equal to or less than 41° may be adjusted to change in a nearly linear manner corresponding to the size of the loft angle θ of each of the golf club numbers . More specifically, the moments of inertia Y may be adjusted so as to be plotted onto a straight line, or may be adjusted so as to be in a range interposed by two parallel straight lines determined by Eq. (2) if, for example, the moments of inertia Y values do not plot on a straight line. A coefficient c of Eq. (2) may be greater than 15, or be less than or equal to 15.

For a golf club set having the coefficient c of Eq. (2) greater than 15, the moments of inertia Y become larger with respect to the numerical order of the loft angle θ of the golf clubs. Therefore, this is effective for golfers who prefer hitting shots such that the golf ball flight be controlled by utilizing the curve of the golf ball flight with long irons such as the number 3 iron and the number 4 iron, which have small loft angles θ, and on the other hand, who prefer that the relative amount of curve of the golf ball flight when struck by the golf clubs having large club numbers, namely ones having large loft angles θ, be suppressed. It is preferable that the coefficient c be equal to or greater than 16, and more preferably that the coefficient c be equal to or greater than 17. Furthermore, it is preferable that the coefficient c be less than or equal to 35, and more preferably, that the coefficient c be less than or equal to 34.

When the coefficient c of Eq. (2) is equal to or less than 15, the size of the moment of inertia Y does not change much for different golf club loft angles θ, and this becomes a structure in which the golf clubs possess a uniform moment of inertia Y which is relatively large. This is effective for golfers who prefer to hit shots in which curve of the golf ball flight by the golf clubs having large loft angles θ is suppressed, and who prefer to hit shots in which curve of the golf ball flight is relatively suppressed even in long irons such as the 3 iron and the 4 iron which have small loft angles θ. It is preferable that the coefficient c be equal to or less than 14, and it is more preferable that the coefficient c be equal to or less than 13. Furthermore, it is preferable that the coefficient c be greater than or equal to −5, and more preferably, that the coefficient a be greater than or equal to −4.

The moments of inertia Y are thus adjusted with respect to each golf club number of the golf club heads 106 in accordance with setting the coefficient c of Eq. (2) and setting the coefficient b in accompaniment with the coefficient c. Based on this, the size of the sweet area of the face plane can then be unambiguously determined in accordance with a known method of distributing mass or the like, and variation in the golf ball flight distance of each golf club number within the golf club set can be harmonized.

Golf club sets having the coefficient c of Eq. (2) greater than 15 are generally positioned as golf club sets preferred by advanced golfers, but it is not necessarily appropriate for advanced golfers to select this type of golf club set. Even advanced golfers, provided that they are golfers who want to suppress curve of their golf ball flight by every golf club number, may select a golf club set with a value of the coefficient c of Eq. (2) equal to or less than 15 without a problem. A golf club set may be selected to suit one's ability, one's personal preference in golf ball flight, one's preferred strategy, and by one's preferred feel.

Furthermore, for a case of expressing a linear regression of the distribution of the moments of inertia Y ($g \cdot cm^2$) with respect to continuous natural numbers X, beginning from X=1 and starting from the lowest golf club number of the irons A3 to A8, or with respect to the loft angles θ, the sizes of the moments of inertia Y may be adjusted such that all of estimated errors of the linear regression are equal to or less then 30 ($g \cdot cm^2$).

The term estimated errors of the linear regression equal to or less than 30 ($g \cdot cm^2$), denotes that the estimated values calculated when the natural numbers X determined in correspondence with the golf club numbers, or of the loft angles θ, are input to the linear regression function have errors from the values of the moment of inertia Y of the golf clubs, which have absolute values equal to or less than 30 ($g \cdot cm^2$). In other words, the errors are greater than or equal to −30 ($g \cdot cm^2$), and less than or equal to 30 ($g \cdot cm^2$).

In this case it is preferable that the estimated error of linear regression be equal to or less than 20 $g \cdot cm^2$, more preferably equal to or less than 12.5 $g \cdot cm^2$.

Furthermore, the golf club set of the present invention is not limited to having its moments of inertia Y change in a nearly linear fashion with respect to the golf club number or the loft angle θ. It is acceptable that the size of the moment of inertia about an axis perpendicular to the face plane and through the center of mass of the golf club head be adjusted corresponding to the numerical order of the golf club number or to the size of the loft angle for at least three or more golf clubs with the present invention. For example, the values of the above moments of inertia may increase monotonically with respect to the numerical order of the golf club numbers or the loft angles θ, or may decreaae monotonically, the monotonic increase or decrease may be nonlinear, and the values of the above moments of inertia with respect to the golf club numbers or the loft angles θ may be also plotted on a parabola or the like. Further, as a substitute for a range interposed between straight lines as in Eq. (1) and Eq. (2), the values may be plotted with a fixed range interposed between two parabolas.

In addition, the values of the above moments of inertia may also be all nearly the same fixed values.

The irons A3 to A8 of the above embodiment have their mass distribution of the golf club head 106 adjusted so that the moments of inertia satisfy Eq. (1) and Eq. (2) using the predetermined coefficients a and c, and the values of the moment of inertia about an axis perpendicular to the face plane 112 and through the center of mass of the golf club head 106 can be found, as already explained, using the moment of inertia measurement apparatus 11 shown in FIG. 1. The values of the moment of inertia are adjusted so as to correspond to the golf club numbers or the loft angles, as stated above.

The values of the moment of inertia can thus be found in accordance with measuring the moment of inertia about an axis perpendicular to the face plane 112 and through the center of mass of the golf club head 106. Further, the size of the sweet area of the golf club heads can thus be evaluated accurately and unambiguously based on the value of the moments of inertia.

The moment of inertia measured in accordance with the method of evaluating a golf club of the present invention, already explained, satisfies Eq. (1) for the golf club set 100, and the coefficient a is set equal to or less than 60, or is set greater than 60, and therefore the size of the sweet area changes in accordance with the numerical order of the golf club numbers. The variation of the golf ball flight distance therefore changes continuously with respect to the numerical order of the golf club number, and therefore unbalance within a golf club set, in which the variation of the golf ball flight distance in accordance with golf club number is extremely small or extremely large, is eliminated. A golf club set in which the variation of the golf ball flight distance is harmonized can therefore be obtained. Moreover, the feeling when missing the sweet area changes gradually corresponding to the numerical order of the golf club number, and therefore there is no feeling of incompatibility in which only a specific number golf club has a different feel. This point is explained subsequently by Example B.

EXAMPLE A

A ball hitting experiment was performed in order to verify that the size of the sweet area of a golf club is shown accurately by the above stated method of evaluating a golf club.

Method for ball hitting experiment

The ball hitting experiment was performed in accordance with the steps shown below:

1. Golf club manufacture
2. Experimental ball hitting and grading by 50 golfers; and
3. Collection of points for grading and numerical evaluation.

1. Golf Club Manufacture

Golf clubs C1 to C10 having a loft angle equal to 24° and golf clubs C11 to C20 having a loft angle equal to 38° were manufactured. The external shape of the golf club heads, such as: the lie angle, the contour shape of the face plane, the head length, the head width, the height of the head, the face progression, the length of the hosel, and the hoael diameter are identical for the golf club heads structuring the golf clubs C1 to C10, and are identical for the golf club heads structuring the golf clubs C11 to C20. Further, the thickness distribution of a back face portion and the mass distribution to side portions changes between the golf club heads structuring the golf clubs C1 to C10, and changes between the golf club heads structuring the golf clubs C11 to C20. (Moments of inertia 1 and 2 change in accordance with these changes) Before being built into a golf club, the moment of inertia in accordance with the evaluation method of the present invention (the moment of inertia 1) and the moment of inertia in accordance with a conventional evaluation method (the moment of inertia 2) are measured for each golf club head.

The golf club shafts and grips used for structuring the golf clubs C1 to C10 all have identical physical characteristics. Principle physical characteristics are shown below.

Golf club shaft: Dynamic Gold R400, 38.0 inch length, manufactured by True Temper Corporation used.

Grip: Swing Rite M60 manufactured by Golf Pride Corporation used.

Club length: Made into 38.0 inches. Cutting of the butt side portion was performed for adjusting the length of the golf club shaft.

The golf club shafts and grips used for structuring the golf clubs C11 to C20 all have identical physical characteristics. Principle physical characteristics are shown below.

Golf club shaft: Dynamic Gold R400, 36.0 inch length, manufactured by True Temper Corporation used.

Grip. Swing Rite M60 manufactured by Golf Pride Corporation used.

Club length: Made into 36.0 inches. Cutting of the butt side portion was performed for adiusting the length of the golf club shaft.

The golf clubs C1 to C10 correspond to normal 4 irons, and the golf clubs C11 to C20 correspond to normal 8 irons.

2. Experimental Ball Hitting and Grading by 50 Golfers

A golf ball hitting experiment by golfers using each of the 10 types of golf clubs C1 to C10, and C11 to C20 manufactured by step 1 was performed. One golfer hit 10 golf balls each with the golf clubs C1 to C10 and the golf clubs C11 to C20, and in accordance with the ball hitting feel, gave points as follows: one point for a ball hit when he feels he misses the sweet area (poor response from a grip, miss-hit); two points when he feels he hits the golf ball basically at the sweet area Oust off sweet area, not a miss); and three points when he feels he hits right on the sweet area (sweet spot response from a grip, nice shot). Only the evaluation method was taught to each golfer, and it was left up to each individual to interpret the description of the points for themselves, and to judge how many points to give for a specific hitting feel. The golfers hit 10 balls per golf club, and gave evaluation points 10 times. The above experiment was performed by 50 golfers.

3. Collection of Points for Grading and Numerical Evaluation

The points given to each golf club by the 50 golfers in step 2 were totaled and compiled. The full maximum score is 3 (highest evaluation points)×10 (number of evaluations per golfer)×50 (number of golfers)=1500 points.

The point totals for the golf clubs C1 to C10 obtained by step 3 by the above experiment; and the moments of inertia 1 and 2, and the moment of inertia 1/mass, and the moment of inertia 2/mass which are obtained by dividing the moments of inertia/and 2 by the mass of the golf club in step 1, are shown in Table 4. The point totals for the golf clubs C10 to C20; and the moments of inertia 1 and 2, and the moment of inertia 1/mass, and the moment of inertia 2/mass, are shown in Table 5.

TABLE 4

| | Golf Club | | | | | | | | | |
|---|---|---|---|---|---|---|---|---|---|---|
| | C1 | C2 | C3 | C4 | C5 | C6 | C7 | C8 | C9 | C10 |
| Total points | 1014 | 936 | 1087 | 1023 | 891 | 982 | 1015 | 1053 | 1113 | 826 |
| Mass (g) | 247.0 | 249.2 | 248.3 | 247.5 | 249.3 | 247.3 | 248.1 | 247.9 | 248.7 | 247.8 |
| Moment of Inertia 1 (g-cm$^2$) *1 | 2976 | 2746 | 3090 | 2853 | 2516 | 2783 | 3178 | 2989 | 3265 | 2424 |
| Moment of inertia 1/mass | 12.05 | 11.02 | 12.44 | 11.53 | 10.09 | 11.25 | 12.81 | 12.06 | 13.13 | 9.78 |
| Moment pf Inertia 2 (g cm$^2$) *2 | 2558 | 2452 | 2667 | 2386 | 2276 | 2311 | 2855 | 2556 | 2850 | 2211 |
| Moment of Inertia 2/mass | 10.36 | 9.84 | 10.74 | 9.64 | 9.13 | 9.34 | 11.51 | 10.31 | 11.46 | 8.92 |

Table 5

| | Golf Club | | | | | | | | | |
|---|---|---|---|---|---|---|---|---|---|---|
| | C11 | C12 | C13 | C14 | C15 | C16 | C17 | C18 | C19 | C20 |
| Total points | 1256 | 1241 | 1105 | 1169 | 1005 | 1074 | 1308 | 1193 | 1133 | 1036 |
| Mass(g) | 278.9 | 277.0 | 279.5 | 278.6 | 277.7 | 279.3 | 276.8 | 278.2 | 277.9 | 277.5 |
| Moment of inertia 1 (g cm$^2$) *1 | 3156 | 3095 | 2968 | 2826 | 2653 | 2735 | 3452 | 3090 | 2831 | 2734 |
| Moment of inertia 1/mass | 11.32 | 11.17 | 10.62 | 10.14 | 9.55 | 9.79 | 12.47 | 11.11 | 10.19 | 9.85 |
| Moment of inertia 2 (g cm$^2$) *2 | 2744 | 2876 | 2854 | 2617 | 2501 | 2480 | 3279 | 2811 | 2682 | 2519 |
| Moment of inertia 2/mass | 9.84 | 10.38 | 10.21 | 9.39 | 9.01 | 8.88 | 11.85 | 10.10 | 9.65 | 9.08 |

Notations "*1" and "*2" within the tables are explained here.

The symbol *1: the moment of inertia 1 was measured using a Moment of Inertia Instrument Model Moment of Inertia-005-014 manufactured by Inertia Dynamics Corporation as the moment of inertia measurement apparatus, and a Calibration Weight (part number CW005 001) also manufactured by Inertia Dynamics Corporation as the jig. Fixing of the golf club heads was such that the normal line N and the axis of rotation R coincided, as shown in FIG. 3C. The fixing means was in accordance with double sided tape manufactured by Lion Office Products K.K. (part number GW-350). The point g shown in FIG. 4 was found as shown in FIG. 7A by using a C. G. Maker Model FG-102RM manufactured by Forteen Corp. The measurement of the moment of inertia 1 was based on the operating manual written by Inertia Dynamics Corporation. Measurement was performed three times, and an average value for the three measurements was taken as the measured value.

Figure 19:
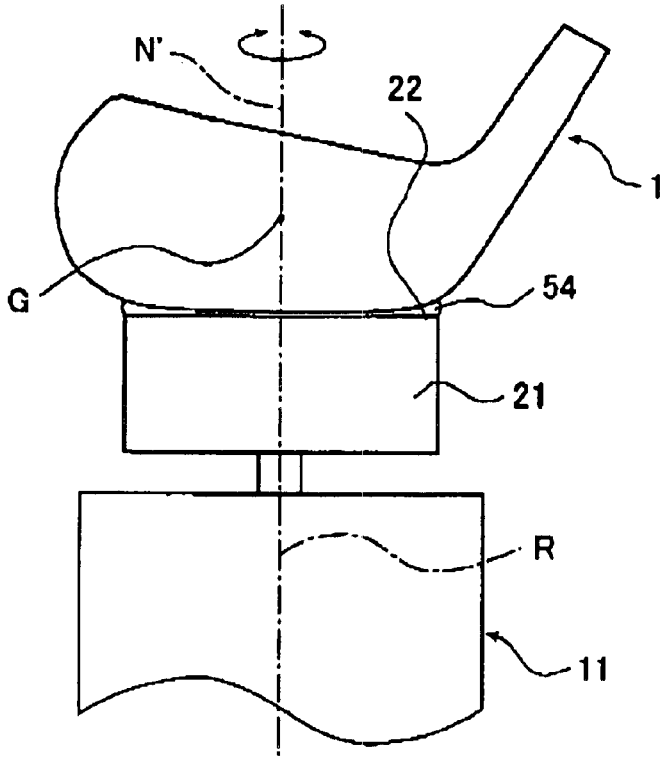
FIG. 19 PRIOR ART
FIG. 19 is a diagram showing a conventional state of measuring a moment of inertia.

The symbol *2: the moment of inertia 2 was measured using a Moment of Inertia Instrument Model Moment of Inertia-005–014 manufactured by Inertia Dynamics Corporation as the moment of inertia measurement apparatus, and a Calibration Weight (part number CW005-001) also manufactured by Inertia Dynamics Corporation as the jig. Fixing of the golf club heads was such that an axis N' (an axis in a vertical direction and through the center of mass of the golf club head) and the axis of rotation R coincided, as shown in FIG. 19. The fixing means was in accordance with fixing putty manufactured by Lion Office Products K. K. (part number QG-10). The axis N' was found as shown in FIG. 20 by using a C. G. Maker Model FG-102RM manufactured by Forteen Corp. The measurement of the moment of inertia 2 was based on the operating manual written by Inertia Dynamics Corporation. Measurement was performed three times, and an average value for the three measurements was taken as the measured value.

The point collected in Tables 4 and 5 is obtained from the above stated 50 golfers, and it can be argued that the larger the values, the easier it is to obtain a feel like that of hitting at the sweet area even though the golfer's hitting positions are variously varied. In other words, even if the point of impact is dispersed, it is easy to obtain the feel of hitting on the sweet area, and the numerical values quantitatively show the size of the sweet area. Further the moment of inertia 1 is a moment of inertia of a golf club head according to an evaluation method of the present invention. On the other hand, the moment of inertia 2 is a moment of inertia of the golf club heads in accordance with a conventional method of evaluation. The values of the moment of inertia 2 purport to show that the larger they are, the larger the sweet area is.

In order to determine whether or not the moments of inertia 1 and 2 quantitatively show the size of the sweet area, a Pearson product-moment correlation coefficient was used, and the correlation with respect to the quantitative numerical values of the point totals was found. The higher the correlation with the compiled points, the larger the value of the correlation coefficient becomes, and it can be said that this quantitatively shows further the size of the sweet area. On the other hand, it can also be said the size of the sweet area is accurately shown by the numerical values. The correlation coefficient between the compiled points and the moment of inertia 1 was taken as r1, the correlation coefficient between the compiled points and (the moment of inertia 1/mass) was taken as r2. In addition, the correlation coefficient between the compiled points and the moment of inertia 2 was taken as r3, the correlation coefficient between the compiled points and (the moment of inertia 2/mass) was taken as r4. The correlation coefficients r1, r2, r3, and r4 were found for the group of 24° loft angle golf club sets C1 to C10, and for the group of 38° loft angle golf club sets C11 to C20. The correlation coefficients r1, r2, r3, and r4 are shown in Table 6 for both groups of golf clubs.

TABLE 6

| | r1 | r2 | r3 | r4 |
|---|---|---|---|---|
| C1–C10 Group | 0.931 | 0.932 | 0.787 | 0.794 |
| C11–C20 Group | 0.923 | 0.922 | 0.812 | 0.810 |

It can be seen that for both the group of 24° loft angle golf clubs C1 to C10, and the group of 38° loft angle golf clubs C11 to C20, the correlation coefficient r1 between the compiled points and the moment of inertia 1, and the correlation coefficient r2 between the compiled points and (the moment of inertia 1/mass) , found in accordance with the method of evaluation of the present invention, are larger than the correlation coefficient r3 between the compiled points and the moment of inertia 2, and the correlation coefficient r4 between the compiled points and (the moment of inertia 2/mass) found in accordance with a conventional method of evaluation, there are a higher correlations, and it can be understood that the moment of inertia 1 and (the moment of inertia 1/mass) of the present invention accurately show the size of the sweet area of the golf clubs numerically.

It thus becomes possible to accurately indicate the size of the sweet area of a golf club by numerical values in accordance with the method of evaluating a golf club of the present invention. Further, an evaluation of a golf club can be given based upon the moment of inertia which very appropriately and accurately indicates the size of the sweet area. Moment of inertia information is, for example, displayed on a portion of the golf club, and therefore it becomes extremely easy for a golfer to purchase a golf club suited to the golfer.

It is verified next that the above golf club sets are ones in which balance is achieved with regard to dispersion of ball flight distances.

EXAMPLE B

Six iron golf clubs A'3 to A'8 having a loft angle θ within a range equal to or greater than 16° and equal to or less than 41° were extracted from a golf club set. Sixteen types (examples 1 to 16) for the six golf clubs composing the golf club set of the present invention, or a part of the golf club set of the present invention, were manufactured in accordance with changing the thickness distribution of a back face portion of each golf club head and changing the mass distribution to a side portion of each golf club head. In addition, two types (comparative examples 1 and 2) of six golf clubs composing golf club sets which are not included in the golf club sets of the present invention were also manufactured.

The golf clubs were manufactured so that the external appearance shapes of the golf club such as the lie angle of the golf club head, the contour shape of the face plane, the length of the head, the head width, the face progression, the hosel length, and the hotel diameter were identical for the same golf club numbers. Further, the loft angle θ was measured using a GOLF CLUB HEAD GAUGE (manufactured by Sheng Feng Company (TAIWAN)), and the golf clubs A'3 were found to have loft angles of 20°, the golf clubs A'4 were 24°, A'5 were 28°, A'6 were 32°, A'7 were 36°, and A'8 were 40°.

On the other hand, the values of the moment of inertia about an axis perpendicular to the face plane and through the center of mass of the golf club head was measured, before constructing the golf clubs, as follows.

Namely, a Moment of Inertia Instrument Model Moment of Inertia-005-014 manufactured by Inertia Dynamics Corporation was used as the moment of inertia measurement apparatus 11, and a Calibration Weight (part number CW005-001) also manufactured by Inertia Dynamics Corporation was used as the jig. Fixing of the golf club heads was such that the normal line N and the axis of rotation R coincided, as shown in FIG. 3C. The golf club heads were fixed by double sided tape manufactured by Lion Office Products K. K. (part number GW-350). The point g shown in FIG. 4 was found as shown in FIG. 7A by using a C. G. Maker Model FG-102RM manufactured by Forteen Corp. The measurement of the moment of inertia was based on the operating manual written by Inertia Dynamics Corporation. Measurement was performed three times, and an average value for the three measurements was taken as the measured value.

Figure 27:
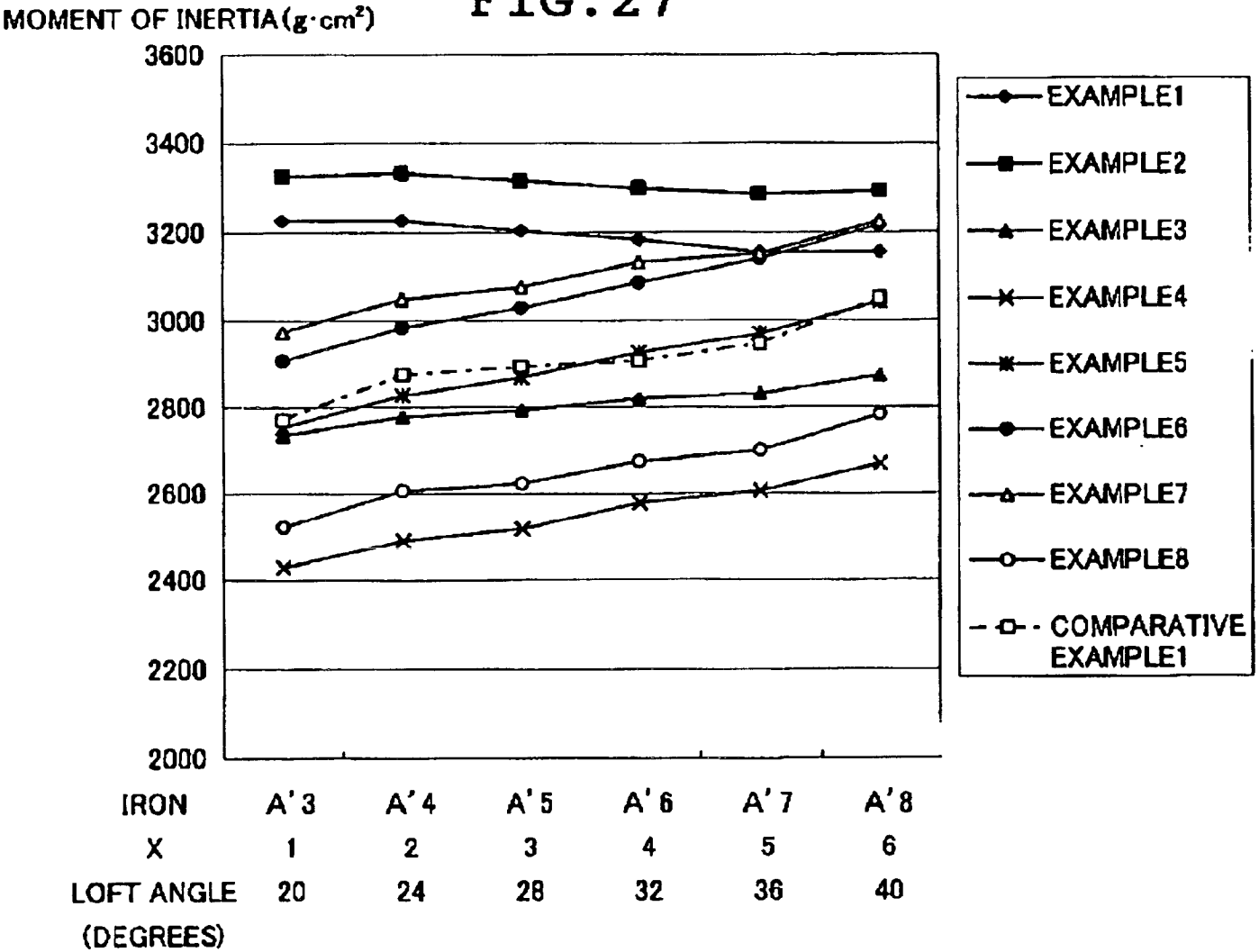
FIG. 27 is a diagram showing an example of a moment of inertia changing in correspondence with a golf club number.
Figure 28:
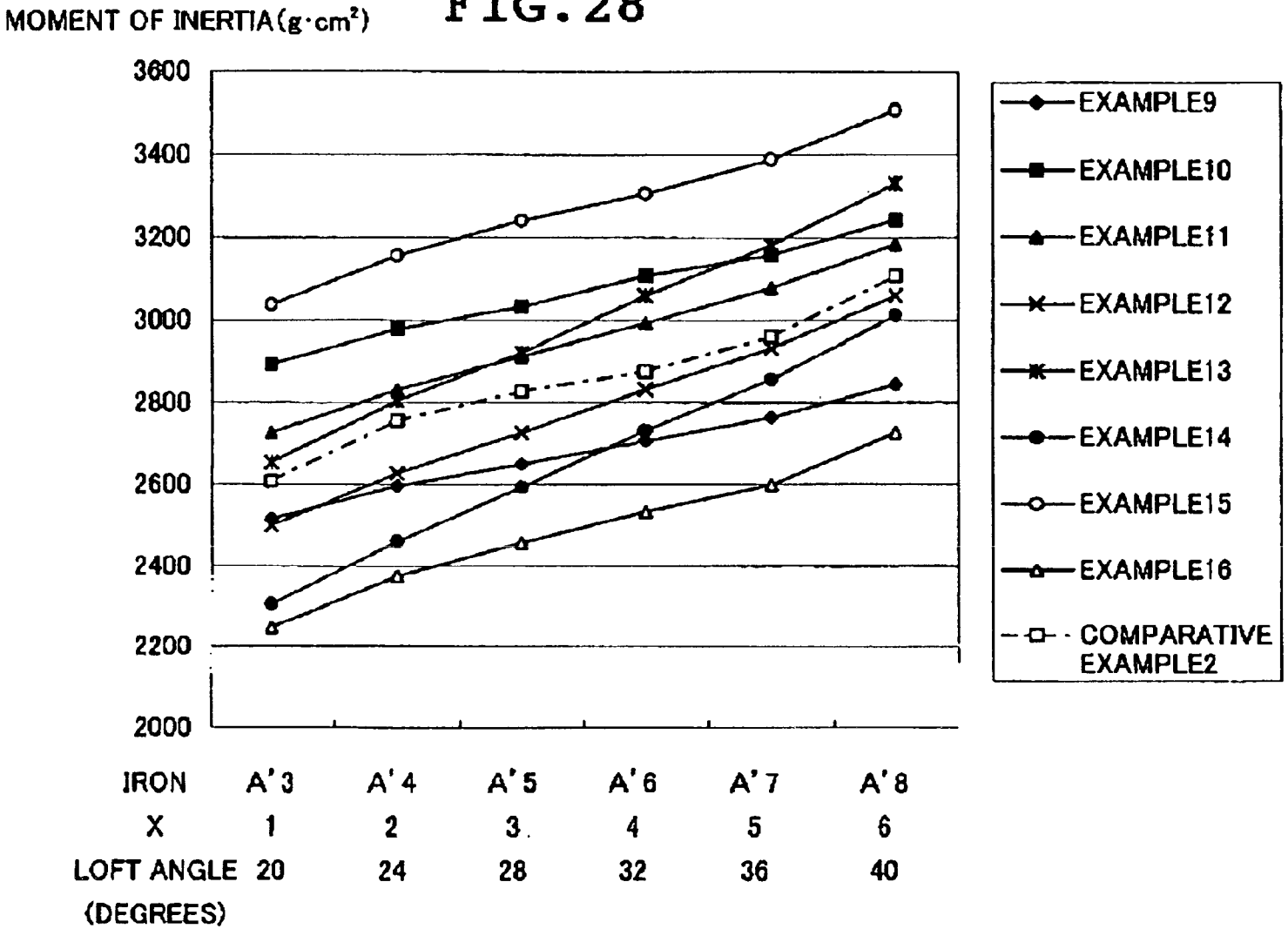
FIG. 28 is a diagram showing another example of a moment of inertia changing in correspondence with the golf club number.

FIG. 27 and FIG. 28 are diagrams showing how value of the moment of inertia about an axis perpendicular to the face plane and through the center of mass of the golf club head changes in accordance with each golf club number for the irons A'3 to A'8 of Examples 1 to 16, and for the irons A'3 to A'8 of Comparative Examples 1 and 2.

Further, values of the coefficients a and b, the coefficients c and d, a width $\Delta_1$, and a width $\Delta_2$ are shown in Table 7. The term width $\Delta_1$ denotes the width of a region, within which each plot point of Examples 1 to 16 of FIG. 27 and FIG. 28 is located, in accordance with two parallel straight lines made by the coefficients a and b. Similarly, the term width $\Delta_2$ denotes the width of a region, within which each plot point of Examples 1 to 16 of FIG. 27 and FIG. 28 is located, in accordance with two parallel straight lines made by the coefficients c and d.

It is clear that for each of Examples 1 to 8, the value of the coefficient a is equal to or less than 60, the value of the coefficient c is equal to or less than 15, and the width $\Delta_1$ becomes equal to or less than 50. On the other hand, the value of the coefficient a is larger than 60 and the value of the coefficient c is larger than 15 for each of Examples 9 to 16, and the width $\Delta_2$ also becomes equal to or less than 50. In other words, Examples 1 to 16 satisfy Eq. (1) and Eq. (2).

Comparative Examples 1 and 2 did not satisfy Eq. (1) and Eq. (2), however. Namely, the width $\Delta_1$ selected of the narrowest range of the ranges which are formed by two parallel straight lines in Comparative Examples 1 is 60, which does not satisfy Eq. (1) , and the width $\Delta_2$ selected of the narrowest range of the ranges which are formed by two parallel straight lines in comparative example 2 is 60, which does not satisfy Eq. (2).

Further, when the irons A'3 to A'8 are expressed by consecutive natural numbers X beginning with X=1 and in order, starting with the smallest golf club number, a linear regression of the distribution of the moment of inertia Y ($g \cdot cm^2$) of the irons A'3 to A'8 with respect to the natural numbers X is expressed by $Y=a' \cdot X+b'$. A linear regression of the moment of inertia Y with respect to the loft angles θ is expressed by $Y=c' \cdot \theta+d'$. Coefficients a', b', c', and d', the largest errors of the irons A'to A'8, $\Delta_3^+$, $\Delta_3^-$, $\Delta_4^+$, and $\Delta_4^-$ are shown as numerical values in Table 8.

Note that the term error $\Delta_3^+$ denotes the largest estimated error in which the moment of inertia Y is larger than the estimated value of the moment of inertia Y estimated by linear regression. The term error $\Delta_3^-$ denotes the largest estimated error in which the moment of inertia Y is smaller than the estimated value of the moment of inertia Y estimated by linear regression. The error $\Delta_4^+$ and the error $\Delta_4^-$ are defined similar to the error $\Delta_3^+$ and error $\Delta_3^-$. The estimated errors were determined to be less than 30 $g \cdot cm^2$ for each of Examples 1 to 16. On the other hand, the estimated errors for both Comparative Examples 1 and 2 are larger than 30 $g \cdot cm^2$.

TABLE 7

| | Equation(1) | | | Equation(2) | | |
|---|---|---|---|---|---|---|
| | Coefficient a | Coefficient b | Width $\Delta_1$ | Coefficient c | Coefficient d | Width $\Delta_2$ |
| Example 1 | −18 | 3245 | 18 | −4.5 | 3317 | 18 |
| Example 2 | −10 | 3336 | 17 | −2.5 | 3376 | 17 |
| Example 3 | 24 | 2711 | 19 | 6 | 2615 | 19 |
| Example 4 | 44 | 2386 | 18 | 11 | 2210 | 18 |
| Example 5 | 54 | 2700 | 19 | 13.5 | 2484 | 19 |
| Example 6 | 58 | 2850 | 18 | 14.5 | 2618 | 18 |
| Example 7 | 44 | 2931 | 30 | 11 | 2755 | 30 |
| Example 8 | 44 | 2479 | 40 | 11 | 2303 | 40 |
| Example 9 | 62 | 2454 | 18 | 15.5 | 2206 | 18 |
| Example 10 | 66 | 2827 | 19 | 16.5 | 2563 | 19 |
| Example 11 | 88 | 2638 | 17 | 22 | 2286 | 17 |
| Example 12 | 108 | 2392 | 19 | 27 | 1960 | 19 |
| Example 13 | 132 | 2521 | 19 | 33 | 1993 | 19 |
| Example 14 | 138 | 2167 | 17 | 34.5 | 1615 | 17 |
| Example 15 | 88 | 2949 | 30 | 22 | 2597 | 30 |
| Example 16 | 88 | 2159 | 40 | 22 | 1807 | 40 |
| Comparative Example 1 | 44 | 2727 | 60 | 11 | 2551 | 60 |
| Comparative Example 2 | 88 | 2519 | 60 | 22 | 2167 | 60 |

TABLE 8

| | Equation (5) | | | | Equation (6) | | | |
|---|---|---|---|---|---|---|---|---|
| | Coefficient a' | Coefficient b' | Error $\Delta_3^+$ | Error $\Delta_3^-$ | Coefficient c' | Coefficient d' | Error $\Delta_4^+$ | Error $\Delta_4^-$ |
| Example 1 | 17.03 | 3251 | 9.8 | −11.1 | −4.26 | 3319 | 9.8 | −11.1 |
| Example 2 | −9.23 | 3341 | 10.3 | −9.0 | −2.31 | 3378 | 10.3 | −9.0 |
| Example 3 | 25.14 | 2717 | 10.7 | −11.7 | 6.29 | 2616 | 10.7 | −11.7 |
| Example 4 | 45.46 | 2390 | 11.4 | −11.0 | 11.36 | 2208 | 11.4 | −11.0 |
| Example 5 | 55.20 | 2705 | 11.5 | −11.1 | 13.80 | 2484 | 11.5 | −11.1 |
| Example 6 | 58.97 | 2854 | 12.1 | −8.8 | 14.74 | 2618 | 12.1 | −8.8 |
| Example 7 | 46.09 | 2940 | 17.0 | −19.3 | 11.52 | 2756 | 17.0 | −19.3 |
| Example 8 | 46.49 | 2489 | 25.2 | −22.2 | 11.62 | 2303 | 25.2 | −22.2 |
| Example 9 | 62.89 | 2459 | 11.2 | −9.5 | 15.72 | 2208 | 11.2 | −9.5 |
| Example 10 | 67.34 | 2832 | 10.8 | −12.2 | 16.84 | 2563 | 10.8 | −12.2 |
| Example 11 | 88.77 | 2643 | 10.3 | −9.0 | 22.19 | 2288 | 10.3 | −9.0 |
| Example 12 | 109.03 | 2398 | 11.2 | −10.9 | 27.26 | 1962 | 11.2 | −10.9 |
| Example 13 | 133.26 | 2525 | 12.2 | −10.6 | 33.31 | 1992 | 12.2 | −10.6 |
| Example 14 | 139.00 | 2173 | 8.7 | −11.3 | 34.75 | 1617 | 8.7 | −11.3 |
| Example 15 | 89.09 | 2961 | 16.0 | −17.3 | 22.27 | 2605 | 16.0 | −17.3 |
| Example 16 | 89.97 | 2175 | 20.1 | −25.8 | 22.49 | 1815 | 20.1 | −25.8 |
| Comparative Example 1 | 46.54 | 2745 | 37.3 | −30.3 | 11.64 | 2558 | 37.3 | −30.3 |
| Comparative Example 2 | 90.29 | 2539 | 35.4 | −31.4 | 22.57 | 2178 | 35.4 | −31.4 |

Fifty people hit 10 golf balls with each golf club of the golf club sets of the Examples 1 to 16 and the golf club sets of the Comparative Examples 1 and 2, the golf ball flight distance was measured for each golf club number and standard deviations were found, and the averaged standard deviation on the 50 people gave variation of the golf ball flight distance. The results are shown in Table 9. Further, in order to ascertain the correlation between each golf club number and the variation of the golf ball flight distance, a Pearson moment correlation coefficient was found. These results are shown in Table 10.

TABLE 9

| | Example 1 | Example 2 | Example 3 | Example 4 | Example 5 | Example 6 | Example 7 | Example 8 | Comparative Example 1 |
|---|---|---|---|---|---|---|---|---|---|
| A'3 | 11.86 | 11.43 | 14.30 | 16.21 | 14.20 | 13.29 | 13.81 | 17.83 | 17.80 |
| A'4 | 9.92 | 9.61 | 11.54 | 12.87 | 11.33 | 10.74 | 10.50 | 12.29 | 11.14 |
| A'5 | 9.31 | 9.03 | 10.92 | 12.80 | 10.78 | 10.24 | 10.35 | 13.09 | 11.49 |
| A'6 | 8.42 | 8.35 | 9.51 | 10.13 | 9.19 | 9.03 | 8.44 | 10.92 | 12.03 |
| A'7 | 7.79 | 7.42 | 8.82 | 9.61 | 8.37 | 7.83 | 8.29 | 10.51 | 10.52 |
| A'8 | 6.01 | 5.77 | 6.62 | 7.12 | 6.25 | 5.92 | 5.88 | 6.83 | 6.23 |

| | Example 9 | Example 10 | Example 11 | Example 12 | Example 13 | Example 14 | Example 15 | Example 16 | Comparative Example 2 |
|---|---|---|---|---|---|---|---|---|---|
| A'3 | 15.60 | 13.43 | 14.19 | 15.80 | 14.78 | 17.07 | 13.50 | 20.65 | 19.31 |
| A'4 | 12.33 | 10.76 | 11.31 | 12.19 | 11.43 | 13.01 | 10.17 | 13.49 | 11.63 |
| A'5 | 11.54 | 10.16 | 10.33 | 11.21 | 10.77 | 11.52 | 9.01 | 12.25 | 11.22 |
| A'6 | 10.33 | 8.41 | 9.27 | 9.68 | 8.84 | 9.64 | 8.73 | 11.32 | 12.21 |
| A'7 | 9.02 | 7.82 | 7.97 | 8.49 | 7.75 | 8.63 | 7.61 | 11.02 | 10.46 |
| A'8 | 6.68 | 5.86 | 5.96 | 6.21 | 5.70 | 6.31 | 5.41 | 6.98 | 6.12 |

From Table 9, in summary the variation of the golf ball flight distance becomes smaller with larger golf club number, and this is mainly because the larger the golf club number, the shorter the ball flight distance itself. To the tendency of this variation which tends to be smaller as an actual ball flight distance gets shorter, the effect of the variation of the golf ball flight distance due to the moment of inertia is added. The effect of variation of the golf ball flight distance caused by the moment of inertia can therefore be extracted in accordance with a correlation coefficient between the numerical order of the golf club number, or the loft angle 0, and the variation of the golf ball flight distance.

TABLE 10

(insert table)

| | Correlation coefficient |
|---|---|
| Example 1 | −0.982 |
| Example 2 | −0.983 |
| Example 3 | −0.979 |
| Example 4 | −0.975 |
| Example 5 | −.0982 |
| Example 6 | −0.984 |
| Example 7 | −0.960 |
| Example 8 | −0.924 |
| Comparative Example 1 | −0–852 |
| Example 9 | −0.980 |
| Example 10 | −0.983 |
| Example 11 | −0.985 |
| Example 12 | −0.981 |

TABLE 10-continued (insert table)

| | Correlation coefficient |
|---|---|
| Example 13 | −0.984 |
| Example 14 | −0.979 |
| Example 15 | −0.958 |
| Example 16 | −0.910 |
| Comparative Example 2 | −0.858 |

For irons A'3 to A'8, variation of the golf ball flight distance get smaller as the golf club number increases, and as shown in Table 10, the variation of flight distance has a negative correlation coefficient with golf club number. However, the absolute value of the correlation coefficient is equal to or greater than 0.9 for all of Examples 1 to 16, and in some cases is equal to or greater than 0.95. The tendency is for the variation of the golf ball flight distance to become smaller as the golf club number increases, and the variation of the golf ball flight distance is adjusted corresponding to the golf club number, and therefore a control of the ball flight distance can be easily performed corresponding to the golf club number. On the other hand, the absolute values of the correlation coefficients for Comparative Examples 1 and 2 are shown by the values 0.852 and 0.858, respectively. The tendency that the variation of the golf ball flight distance becomes smaller with increasing golf club number becomes less clear, and it can be seen that it is difficult to control the golf ball flight distance corresponding to the golf club number.

It is clear that the golf club sets of Examples 1 to 16, in comparison with those of Comparative Examples 1 and 2, have the variation of the golf ball flight distance changing continuously in correspondence with the numerical order of the golf club numbers or the loft angle.

With the golf clubs of the golf club sets of the present invention, the size of the sweet area of the golf clubs of the golf club sets can be made to change corresponding to the numerical order of the golf clubnumbers or the size of the loft angles, and therefore control of ball flight distance can easily be performed in correspondence with the golf club number.

The method of evaluating a golf club, the golf club, and the golf club set of the present invention have thus been explained in detail, but the present invention is not limited to the above Examples. It is of course possible to make improvements and changes within a range that does not deviate from the gist of the present invention.

What is claimed is:

1. A golf club set comprising at least three golf clubs having different loft angles, wherein each of the golf clubs has the size of the moment of inertia about an axis perpendicular to a face plane of golf club head through a center of gravity of the golf club head adjusted corresponding to an order of golf club number and wherein the moment of inertia changes linearly in correspondence with the order of the golf club number.

2. A golf club set comprising at least three golf clubs having different loft angles, wherein each of the golf clubs has the size of the moment of inertia about an axis perpendicular to a face plane of golf club head through a center of gravity of the golf club head adjusted corresponding to an order of golf club number and wherein:

the golf club set has a group of at least three golf clubs having loft angles in a range greater than or equal to 16° and less than or equal to 41°; and when each of the golf clubs of the group is expressed as a continuous natural number X, beginning with a smallest golf club number which is taken as X=1, and when the moment of inertia is taken as Y ($g \cdot cm^2$), then the moment of inertia Y of each of golf clubs of the group is adjusted within a range defined by equation (1) below, with respect to the natural number X:

$$a \cdot X+b \leqq Y \leqq a \cdot X+b+50, \quad (1)$$

where coefficients a and b are constants.

3. The golf club set according to claim 2, wherein:

the coefficient a of the equation (1) is equal to or less than 60.

4. The golf club set according to claim 2, wherein:

the coefficient a of equation (1) is greater than 60.

5. A golf club set comprising at least three golf clubs having different loft angles, wherein each of the golf clubs has the size of the moment of inertia about an axis perpendicular to a face plane of golf club head through a center of gravity of the golf club head adjusted corresponding to an order of golf club number and wherein:

the golf club set has a group of at least three golf clubs having loft angles in a range greater than or equal to 16° and less than or equal to 41°;and when each of the golf clubs of the group is expressed as a continuous natural number X, beginning with a smallest golf club number which is taken as X=1, and when a distribution of the moments of inertias of all of the golf clubs of the group with respect to the natural number X is regressed by a linear regression line, the sizes of the moments of inertia of all of the golf clubs of the group are adjusted such that all of the estimated errors in the linear regression line of the moments of inertias of all of the golf clubs of the group are equal to or less than 30 $g \cdot cm^2$.

6. A golf club set comprising at least three golf clubs having different loft angles, wherein each of the golf clubs has the size of the moment of inertia about an axis perpendicular to a face plane of a golf club head through a center of gravity of the golf club head adjusted corresponding to an order of value of loft angle and wherein the moment of inertia changes linearly in correspondence with the size of the loft angle of each of the golf clubs.

7. A golf club set comprising at least three golf clubs having different loft angles, wherein each of the golf clubs has the size of the moment of inertia about an axis perpendicular to a face plane of golf club head through a center of gravity of the golf club head adjusted corresponding to an order of value of loft angle and wherein:

the golf club set has a group of at least three golf clubs having loft angles in a range greater than or equal to 16° and less than or equal to 41°; and when the loft angle of each of the golf clubs of the group is taken as θ°, and the moment of inertia is taken as Y($g \cdot cm^2$), then the moment of inertia Y of each of golf clubs of the group is adjusted within a range defined by equation (2) below, with respect to the loft angle θ:

$$c\cdot\theta+d\leqq Y\leqq c\cdot\theta+d+50, \quad (2)$$

where coefficients c and d are constants.

8. The golf club set according to claim 7, wherein:

the coefficient c of the equation (2) is equal to or less than 15.

9. The golf club set according to claim 7, wherein:

the coefficient c of the equation (2) is greater than 15.

10. A golf club set comprising at least three golf clubs having different loft angles, wherein each of the golf clubs has the size of the moment of inertia about an axis perpendicular to a face plane of a golf club head through a center of gravity of the golf club head adjusted corresponding to an order of value of loft angle and, wherein:

the golf club set has a group of at least three golf clubs having loft angles in a range greater than or equal to 16° and less than or equal to 41°; and when a distribution of the moments of inertias of all of the golf clubs of the group with respect to the loft angles is regressed by a linear regression line, the sizes of the moments of inertias of all of the golf clubs of the group are adjusted such that all of estimated errors in the linear regression line of the moments of inertias of all of the golf clubs of the group are equal to or less than 30 $g\cdot cm^2$.

* * * * *